US011700678B2

(12) United States Patent
Bowser et al.

(10) Patent No.: US 11,700,678 B2
(45) Date of Patent: Jul. 11, 2023

(54) LIGHT FIXTURE WITH NFC-CONTROLLED LIGHTING PARAMETERS

(71) Applicant: IDEAL Industries Lighting LLC, Racine, WI (US)

(72) Inventors: Robert Bowser, Cary, NC (US); John Roberts, Cary, NC (US); Kory Liszt, Apex, NC (US); Michael James Harris, Cary, NC (US); Paul Pickard, Acton, CA (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 0 days.

(21) Appl. No.: 17/706,305

(22) Filed: Mar. 28, 2022

(65) Prior Publication Data

US 2022/0217821 A1 Jul. 7, 2022

Related U.S. Application Data

(63) Continuation of application No. 16/930,533, filed on Jul. 16, 2020, now Pat. No. 11,291,090, which is a (Continued)

(51) Int. Cl.
*H05B 47/19* (2020.01)
*H05B 45/20* (2020.01)
(Continued)

(52) U.S. Cl.
CPC ..... *H05B 45/20* (2020.01); *H05B 45/10* (2020.01); *H05B 47/18* (2020.01); *H05B 47/19* (2020.01);
(Continued)

(58) Field of Classification Search
CPC .... H05B 47/105; H05B 47/135; H05B 47/17; H05B 47/175; H05B 47/19; H05B 47/195
See application file for complete search history.

(56) References Cited

U.S. PATENT DOCUMENTS 1,099,061 A 6/1914 Lane
D259,514 S 6/1981 Welch
(Continued)

FOREIGN PATENT DOCUMENTS

CA 2426769 A1 5/2002
CA 2511368 A1 5/2002
(Continued)

OTHER PUBLICATIONS

Non-Final Office Action for U.S. Appl. No. 16/930,533, dated May 17, 2021, 6 pages.
(Continued)

*Primary Examiner* — Tung X Le
(74) *Attorney, Agent, or Firm* — Withrow & Terranova, P.L.L.C.

(57) ABSTRACT

A fixture configuration module comprises a connector configured to be removably coupled with a light fixture. The fixture configuration module also comprises fixture control circuitry communicatively coupled to the connector and configured to control the light fixture to produce light in accordance with a range of a lighting parameter. The range includes at least a subset of values supported by the light fixture for producing light. The fixture configuration module further comprises range control circuitry communicatively coupled to the fixture control circuitry and configured to wirelessly receive the range at least while the connector is uncoupled from the light fixture, and designate the range to the fixture control circuitry while the connector is coupled to the light fixture.

20 Claims, 16 Drawing Sheets

Related U.S. Application Data continuation of application No. 16/410,493, filed on May 13, 2019, now Pat. No. 10,721,808, which is a continuation of application No. 15/783,505, filed on Oct. 13, 2017, now Pat. No. 10,342,102, which is a continuation-in-part of application No. 13/868,021, filed on Apr. 22, 2013, now Pat. No. 9,980,350, which is a continuation-in-part of application No. 13/782,040, filed on Mar. 1, 2013, now Pat. No. 8,975,827, and a continuation-in-part of application No. 13/589,928, filed on Aug. 20, 2012, now Pat. No. 10,506,678, and a continuation-in-part of application No. 13/589,899, filed on Aug. 20, 2012, now Pat. No. 10,219,338.

(60) Provisional application No. 61/738,749, filed on Dec. 18, 2012, provisional application No. 61/666,920, filed on Jul. 1, 2012.

(51) Int. Cl.

| | |
|---|---|
| ***H05B 45/10*** | (2020.01) |
| ***H05B 47/18*** | (2020.01) |
| *F21V 13/04* | (2006.01) |
| *F21K 9/275* | (2016.01) |
| *F21Y 113/10* | (2016.01) |
| *F21Y 115/10* | (2016.01) |
| *F21S 8/02* | (2006.01) |
| *F21V 29/74* | (2015.01) |
| *F21V 3/02* | (2006.01) |
| *F21V 7/00* | (2006.01) |
| *F21V 5/04* | (2006.01) |
| *F21K 9/278* | (2016.01) |

(52) U.S. Cl.

CPC ..... *F21K 9/275* (2016.08); *F21K 9/278* (2016.08); *F21S 8/026* (2013.01); *F21V 3/02* (2013.01); *F21V 5/04* (2013.01); *F21V 7/00* (2013.01); *F21V 13/04* (2013.01); *F21V 29/74* (2015.01); *F21Y 2113/10* (2016.08); *F21Y 2115/10* (2016.08)

(56) References Cited

U.S. PATENT DOCUMENTS

| | | | | |
|---|---|---|---|---|
| 5,079,680 | A | 1/1992 | Kohn | |
| 5,471,119 | A | 11/1995 | Ranganath et al. | |
| 6,100,643 | A | 8/2000 | Nilssen | |
| 6,118,230 | A | 9/2000 | Fleischmann | |
| 6,137,408 | A | 10/2000 | Okada | |
| 6,160,359 | A | 12/2000 | Fleischmann | |
| 6,166,496 | A | 12/2000 | Lys et al. | |
| 6,437,692 | B1 | 8/2002 | Petite et al. | |
| 6,441,558 | B1 | 8/2002 | Muthu et al. | |
| 6,528,954 | B1 | 3/2003 | Lys et al. | |
| 6,735,630 | B1 | 5/2004 | Gelvin et al. | |
| 6,826,607 | B1 | 11/2004 | Gelvin et al. | |
| 6,832,251 | B1 | 12/2004 | Gelvin et al. | |
| 6,859,831 | B1 | 2/2005 | Gelvin et al. | |
| 6,914,893 | B2 | 7/2005 | Petite | |
| 6,948,829 | B2 | 9/2005 | Verdes et al. | |
| 6,990,394 | B2 | 1/2006 | Pasternak | |
| 7,009,348 | B2 | 3/2006 | Mogilner et al. | |
| 7,020,701 | B1 | 3/2006 | Gelvin et al. | |
| 7,031,920 | B2 | 4/2006 | Dowling et al. | |
| 7,103,511 | B2 | 9/2006 | Petite | |
| 7,139,562 | B2 | 11/2006 | Matsui | |
| 7,288,902 | B1 | 10/2007 | Melanson | |
| 7,305,467 | B2 | 12/2007 | Kaiser et al. | |
| D560,006 | S | 1/2008 | Garner et al. | |
| 7,344,279 | B2 | 3/2008 | Mueller et al. | |
| D565,771 | S | 4/2008 | Garner et al. | |
| D567,431 | S | 4/2008 | Garner et al. | |
| 7,396,146 | B1 | 7/2008 | Wang | |
| D582,598 | S | 12/2008 | Kramer et al. | |
| 7,482,567 | B2 | 1/2009 | Hoelen et al. | |
| 7,484,008 | B1 | 1/2009 | Gelvin et al. | |
| D586,950 | S | 2/2009 | Garner et al. | |
| D587,390 | S | 2/2009 | Garner et al. | |
| D588,064 | S | 3/2009 | Garner et al. | |
| 7,502,054 | B2 | 3/2009 | Kalapathy et al. | |
| D594,576 | S | 6/2009 | Chan et al. | |
| 7,549,772 | B2 | 6/2009 | Wang | |
| 7,587,289 | B1 | 9/2009 | Sivertsen | |
| 7,638,743 | B2 | 12/2009 | Bartol et al. | |
| 7,649,456 | B2 | 1/2010 | Wakefield et al. | |
| 7,677,767 | B2 | 3/2010 | Chyn | |
| 7,868,562 | B2 | 1/2011 | Salsbury et al. | |
| 7,924,174 | B1 | 4/2011 | Gananathan | |
| 7,924,927 | B1 | 4/2011 | Boesjes | |
| 8,011,794 | B1 | 9/2011 | Sivertsen | |
| 3,035,320 | A1 | 10/2011 | Sibert | |
| D663,048 | S | 7/2012 | Chen | |
| 8,274,928 | B2 | 9/2012 | Dykema et al. | |
| 8,275,471 | B2 | 9/2012 | Huizenga et al. | |
| 8,344,660 | B2 | 1/2013 | Mohan et al. | |
| 8,364,325 | B2 | 1/2013 | Huizenga et al. | |
| 8,466,626 | B2 | 6/2013 | Null et al. | |
| 8,497,634 | B2 | 7/2013 | Scharf | |
| 8,511,851 | B2 | 8/2013 | Van De Ven et al. | |
| 8,536,792 | B1 | 9/2013 | Roosli | |
| 8,536,984 | B2 | 9/2013 | Benetz et al. | |
| D703,841 | S | 4/2014 | Feng et al. | |
| D708,360 | S | 7/2014 | Shibata et al. | |
| 8,952,627 | B2 | 2/2015 | Tomiyama et al. | |
| 9,041,315 | B2 | 5/2015 | Cho et al. | |
| 9,351,381 | B2 | 5/2016 | Verfuerth et al. | |
| 9,408,268 | B2 | 8/2016 | Recker et al. | |
| 9,538,617 | B2 | 1/2017 | Rains, Jr. et al. | |
| 9,686,477 | B2 | 6/2017 | Walters et al. | |
| 10,219,338 | B2 | 2/2019 | Harris | |
| 10,274,183 | B2 | 4/2019 | Randolph et al. | |
| 2002/0195975 | A1 | 12/2002 | Schanberger et al. | |
| 2004/0002792 | A1* | 1/2004 | Hoffknecht ..... | H05B 47/18 324/699 |
| 2004/0051467 | A1 | 3/2004 | Balasubramaniam | |
| 2004/0139741 | A1 | 7/2004 | Balle et al. | |
| 2004/0193741 | A1 | 9/2004 | Pereira | |
| 2005/0111234 | A1 | 5/2005 | Martin et al. | |
| 2005/0127381 | A1 | 6/2005 | Vitta | |
| 2005/0179404 | A1* | 8/2005 | Veskovic ..... | H05B 47/18 315/307 |
| 2006/0022214 | A1 | 2/2006 | Morgan et al. | |
| 2006/0044152 | A1 | 3/2006 | Wang | |
| 2006/0066266 | A1 | 3/2006 | Li Lim | |
| 2006/0125426 | A1 | 6/2006 | Veskovic | |
| 2006/0262545 | A1 | 11/2006 | Piepgras et al. | |
| 2007/0013557 | A1 | 1/2007 | Wang | |
| 2007/0040512 | A1 | 2/2007 | Jungwirth et al. | |
| 2007/0085700 | A1 | 4/2007 | Walters et al. | |
| 2007/0126656 | A1 | 6/2007 | Huang et al. | |
| 2007/0132405 | A1 | 6/2007 | Hillis | |
| 2007/0189000 | A1 | 8/2007 | Papamichael | |
| 2007/0291483 | A1 | 12/2007 | Lys | |
| 2008/0088244 | A1 | 4/2008 | Morishita | |
| 2008/0088435 | A1 | 4/2008 | Cash et al. | |
| 2008/0111498 | A1 | 5/2008 | Budike | |
| 2008/0158887 | A1 | 7/2008 | Zhu et al. | |
| 2008/0197790 | A1 | 8/2008 | Mangiaracina | |
| 2008/0203945 | A1 | 8/2008 | Deurenberg et al. | |
| 2008/0218087 | A1 | 9/2008 | Crouse et al. | |
| 2008/0225521 | A1 | 9/2008 | Waffenschmidt et al. | |
| 2008/0273754 | A1 | 11/2008 | Hick et al. | |
| 2009/0086492 | A1 | 4/2009 | Meyer | |
| 2009/0184616 | A1 | 7/2009 | Van De Ven et al. | |
| 2009/0212718 | A1 | 8/2009 | Kawashima et al. | |
| 2009/0219727 | A1 | 9/2009 | Weaver | |
| 2009/0231832 | A1 | 9/2009 | Zukauskas | |
| 2009/0237011 | A1* | 9/2009 | Shah ..... | F21S 8/035 313/1 |
| 2009/0262189 | A1 | 10/2009 | Marman | |
| 2009/0267540 | A1 | 10/2009 | Chemel et al. | |

(56) References Cited

U.S. PATENT DOCUMENTS

| | | | |
|---|---|---|---|
| 2009/0284169 | A1 | 11/2009 | Valois |
| 2009/0302994 | A1 | 12/2009 | Rhee et al. |
| 2009/0302996 | A1 | 12/2009 | Rhee et al. |
| 2009/0305644 | A1 | 12/2009 | Rhee et al. |
| 2009/0315485 | A1 | 12/2009 | Verfuerth et al. |
| 2009/0315668 | A1 | 12/2009 | Leete, III et al. |
| 2010/0007289 | A1 | 1/2010 | Budike, Jr. |
| 2010/0060195 | A1 | 3/2010 | Tsuboi et al. |
| 2010/0110699 | A1 | 5/2010 | Chou |
| 2010/0134051 | A1 | 6/2010 | Huizenga et al. |
| 2010/0150122 | A1 | 6/2010 | Berger |
| 2010/0177509 | A1 | 7/2010 | Pickard |
| 2010/0182294 | A1 | 7/2010 | Roshan |
| 2010/0203515 | A1 | 8/2010 | Rigler |
| 2010/0262296 | A1 | 10/2010 | Davis et al. |
| 2010/0270935 | A1 | 10/2010 | Otake et al. |
| 2010/0295473 | A1 | 11/2010 | Chemel et al. |
| 2010/0295946 | A1 | 11/2010 | Reed |
| 2010/0301770 | A1 | 12/2010 | Chemel et al. |
| 2010/0301773 | A1 | 12/2010 | Chemel et al. |
| 2010/0301774 | A1 | 12/2010 | Chemel et al. |
| 2011/0025469 | A1 | 2/2011 | Erdmann et al. |
| 2011/0031897 | A1 | 2/2011 | Henig et al. |
| 2011/0057581 | A1 | 3/2011 | Ashar et al. |
| 2011/0080120 | A1 | 4/2011 | Talstra et al. |
| 2011/0095709 | A1 | 4/2011 | Diehl et al. |
| 2011/0101871 | A1 | 5/2011 | Schenk et al. |
| 2011/0115407 | A1 | 5/2011 | Wibben et al. |
| 2011/0133655 | A1 | 6/2011 | Recker |
| 2011/0137757 | A1 | 6/2011 | Paolini |
| 2011/0156596 | A1 | 6/2011 | Salsbury |
| 2011/0178650 | A1 | 7/2011 | Picco |
| 2011/0182065 | A1 | 7/2011 | Negley et al. |
| 2011/0199004 | A1 | 8/2011 | Henig et al. |
| 2011/0199020 | A1 | 8/2011 | Henig et al. |
| 2011/0221350 | A1 | 9/2011 | Staab |
| 2011/0249441 | A1 | 10/2011 | Donegan |
| 2011/0254554 | A1 | 10/2011 | Harbers |
| 2011/0298598 | A1 | 12/2011 | Rhee |
| 2012/0002406 | A1 | 1/2012 | Leadford et al. |
| 2012/0007725 | A1 | 1/2012 | Penisoara et al. |
| 2012/0040606 | A1 | 2/2012 | Verfuerth |
| 2012/0050535 | A1 | 3/2012 | Densham et al. |
| 2012/0082062 | A1 | 4/2012 | Mccormack |
| 2012/0086345 | A1 | 4/2012 | Tran |
| 2012/0091915 | A1 | 4/2012 | Ilyes et al. |
| 2012/0126705 | A1 | 5/2012 | Pezzutti et al. |
| 2012/0130544 | A1 | 5/2012 | Mohan et al. |
| 2012/0135692 | A1 | 5/2012 | Feri et al. |
| 2012/0136485 | A1 | 5/2012 | Weber |
| 2012/0139426 | A1 | 6/2012 | Ilyes et al. |
| 2012/0143357 | A1 | 6/2012 | Chemel et al. |
| 2012/0147604 | A1 | 6/2012 | Farmer |
| 2012/0153840 | A1 | 6/2012 | Dahlen et al. |
| 2012/0176041 | A1 | 7/2012 | Birru |
| 2012/0206050 | A1 | 8/2012 | Spero |
| 2012/0223657 | A1 | 9/2012 | Van De Ven |
| 2012/0224457 | A1 | 9/2012 | Kim et al. |
| 2012/0229048 | A1 | 9/2012 | Archer |
| 2012/0230696 | A1 | 9/2012 | Pederson et al. |
| 2012/0235579 | A1 | 9/2012 | Chemel et al. |
| 2012/0235600 | A1 | 9/2012 | Simonian et al. |
| 2012/0242242 | A1 | 9/2012 | Linz et al. |
| 2012/0242254 | A1 | 9/2012 | Kim |
| 2012/0271477 | A1 | 10/2012 | Okubo et al. |
| 2012/0286700 | A1 | 11/2012 | Maxik et al. |
| 2012/0299485 | A1 | 11/2012 | Mohan et al. |
| 2012/0306375 | A1 | 12/2012 | van de Ven |
| 2012/0306377 | A1 | 12/2012 | Igaki et al. |
| 2012/0320262 | A1 | 12/2012 | Chung |
| 2013/0002157 | A1 | 1/2013 | Van De Ven |
| 2013/0002167 | A1 | 1/2013 | Van De Ven |
| 2013/0013091 | A1 | 1/2013 | Cavalcanti et al. |
| 2013/0026953 | A1 | 1/2013 | Woytowitz |
| 2013/0033872 | A1 | 2/2013 | Randolph et al. |
| 2013/0049606 | A1 | 2/2013 | Ferstl et al. |
| 2013/0051806 | A1 | 2/2013 | Quilici et al. |
| 2013/0057395 | A1 | 3/2013 | Ohashi |
| 2013/0063042 | A1 | 3/2013 | Bora |
| 2013/0069539 | A1 | 3/2013 | So |
| 2013/0077299 | A1 | 3/2013 | Hussell et al. |
| 2013/0088155 | A1 | 4/2013 | Maxik et al. |
| 2013/0088168 | A1 | 4/2013 | Mohan et al. |
| 2013/0147366 | A1 | 6/2013 | Huizenga |
| 2013/0154831 | A1 | 6/2013 | Gray |
| 2013/0155392 | A1 | 6/2013 | Barrilleaux et al. |
| 2013/0155672 | A1 | 6/2013 | Vo et al. |
| 2013/0200805 | A1 | 8/2013 | Scapa et al. |
| 2013/0221857 | A1 | 8/2013 | Bowers |
| 2013/0229784 | A1 | 9/2013 | Lessard et al. |
| 2013/0293112 | A1 | 11/2013 | Reed et al. |
| 2013/0307419 | A1 | 11/2013 | Simonian |
| 2013/0320862 | A1 | 12/2013 | Campbell et al. |
| 2013/0328486 | A1 | 12/2013 | Jones |
| 2013/0342911 | A1 | 12/2013 | Bartol et al. |
| 2014/0001959 | A1 | 1/2014 | Motley et al. |
| 2014/0001962 | A1 | 1/2014 | Harris |
| 2014/0001963 | A1 | 1/2014 | Chobot et al. |
| 2014/0001977 | A1 | 1/2014 | Zacharchuk et al. |
| 2014/0062678 | A1 | 3/2014 | de Clercq et al. |
| 2014/0072211 | A1 | 3/2014 | Kovesi et al. |
| 2014/0167621 | A1 | 6/2014 | Trott et al. |
| 2014/0167646 | A1 | 6/2014 | Zukauskas et al. |
| 2014/0212090 | A1 | 7/2014 | Wilcox et al. |
| 2014/0268790 | A1 | 9/2014 | Chobot et al. |
| 2014/0312777 | A1 | 10/2014 | Shearer et al. |
| 2015/0008827 | A1 | 1/2015 | Carrigan et al. |
| 2015/0008829 | A1 | 1/2015 | Lurie et al. |
| 2015/0022096 | A1 | 1/2015 | Deixler |
| 2015/0042243 | A1 | 2/2015 | Picard |
| 2015/0048758 | A1 | 2/2015 | Carrigan et al. |
| 2015/0189724 | A1 | 7/2015 | Karc et al. |
| 2015/0195883 | A1 | 7/2015 | Harris et al. |
| 2015/0305119 | A1 | 10/2015 | Hidaka et al. |
| 2015/0342011 | A1 | 11/2015 | Brochu |
| 2015/0345762 | A1 | 12/2015 | Creasman et al. |
| 2015/0351169 | A1 | 12/2015 | Pope et al. |
| 2015/0351191 | A1 | 12/2015 | Pope et al. |
| 2015/0382424 | A1 | 12/2015 | Knapp et al. |
| 2016/0029464 | A1 | 1/2016 | Hughes |
| 2016/0100086 | A1 | 4/2016 | Chien |
| 2016/0302279 | A1 | 10/2016 | Pope et al. |
| 2016/0323972 | A1 | 11/2016 | Bora et al. |
| 2017/0265277 | A1 | 9/2017 | Nolan |
| 2017/0280533 | A1 | 9/2017 | Dimberg et al. |

FOREIGN PATENT DOCUMENTS

| | | | |
|---|---|---|---|
| CN | 101444145 | A | 5/2009 |
| EP | 2440017 | A2 | 4/2012 |
| JP | 11345690 | H | 12/1999 |
| JP | 2001155870 | A | 6/2001 |
| JP | 2003178889 | A | 6/2003 |
| JP | 2010050069 | A | 3/2010 |
| JP | 2010073633 | A | 4/2010 |
| JP | 2010198877 | A | 9/2010 |
| JP | 2012226993 | A | 11/2012 |
| KR | 20060050614 | A | 5/2006 |
| KR | 20110001782 | A | 1/2011 |
| KR | 20110095510 | A | 8/2011 |
| WO | 2001026068 | A1 | 4/2001 |
| WO | 2001026333 | A2 | 4/2001 |
| WO | 2001026335 | A2 | 4/2001 |
| WO | 2002039242 | A1 | 5/2002 |
| WO | 2003047175 | A1 | 6/2003 |
| WO | 2004109966 | A2 | 12/2004 |
| WO | 2006095316 | A1 | 9/2006 |
| WO | 2006130662 | A2 | 12/2006 |
| WO | 2007102097 | A1 | 9/2007 |
| WO | 2009011898 | A2 | 1/2009 |
| WO | 2009076492 | A1 | 6/2009 |
| WO | 2009145747 | A1 | 12/2009 |
| WO | 2009151416 | A1 | 12/2009 |
| WO | 2009158514 | A1 | 12/2009 |

(56) References Cited

FOREIGN PATENT DOCUMENTS

| | | | |
|---|---|---|---|
| WO | 2010010493 | A2 | 1/2010 |
| WO | 2010047971 | A2 | 4/2010 |
| WO | 2010122457 | A2 | 10/2010 |
| WO | 2011070058 | A2 | 6/2011 |
| WO | 2011087681 | A1 | 7/2011 |
| WO | 2011090938 | A1 | 7/2011 |
| WO | 2013050970 | A1 | 4/2013 |
| WO | 2014120971 | A1 | 8/2014 |

OTHER PUBLICATIONS

Examiner-Initiated Interview Summary for U.S. Appl. No. 16/930,533, dated Aug. 31, 2021, 2 pages.

Notice of Allowance for U.S. Appl. No. 16/930,533, dated Nov. 24, 2021, 9 pages.

Author Unknown, "Cluster Analysis", Wikipedia-the free encyclopedia, Updated May 21, 2013, Retrieved on May 30, 2013, http://en.wikipedia.org/wiki/cluster_analysis, 16 pages.

Author Unknown, "Controlling LEDs," Lutron Electronics Co., Inc., Jan. 1, 2011, 16 pages.

Author Unknown, "IEEE Standard for Information Technology—Telecommunications and Information Exchange Between Systems-Local and Metropolitan Area Networks-Specific Requirements—Part 3: Carrier Sense Multiple Access with Collision Detection (CSMA/CD) Access Method and Physical Layer Specifications—Amendment 3: Data Terminal Equipment (DTE) Power via the Media Dependent Interface (MDI) Enhancements," Standard 802.3at-2009, Sep. 11, 2009, The Institute of Electrical and Electronics Engineers, Inc., 141 pages.

Author Unknown, "IEEE Standard for Information Technology—Telecommunications and Information Exchange Between Systems-Local and Metropolitan Area Networks-Specific Requirements—Part 3: Carrier Sense Multiple Access with Collision Detection (CSMA/CD) Access Method and Physical Layer Specifications—Amendment: Data Terminal Equipment (DTE) Power Via Media Dependent Interface (MDI)," Standard 802.3af-2003, Jun. 18, 2003, The Institute of Electrical and Electronics Engineers, Inc., 133 pages.

Author Unknown, "Multi-Agent System", Wikipedia—the free encyclopedia, Updated Apr. 18, 2013, Retrieved May 30, 2013, http://en.wikipedia.org/wiki/multi-agent_system, 7 pages.

Author Unknown, "Section 16950: Distributed Digital Lighting Control System," Lighting Control Devices, Apr. 30, 2013, 20 pages.

Author Unknown, "System Design Guide—Lighting Control & Design: System Overview," Lighting Control and Design, Form No. 1382.057, Accessed Aug. 9, 2013, 4 pages.

Author Unknown, "System Overview & Introduction," nLight Network Lighting Controls, Accessed: Aug. 9, 2013, 4 pages, http://nlightcontrols.com/lighting-controls/overview.

Author Unknown, "The System: Components," Simply5, Accessed: Aug. 9, 2013, 2 pages, http://simply5.net/how.html.

Author Unknown, "White Paper: Breakthrough video technology solves persistent image problems with fluorescent lights and LEDs, while maintaining wide dynamic range," 2009, Pixim, Inc., 7 pages.

Author Unknown, i2C-Bus: What's That?, Updated 2012, Retrieved May 30, 2013, http://www.i2c-bus.org, 1 page.

* cited by examiner

LIGHT FIXTURE WITH NFC-CONTROLLED LIGHTING PARAMETERS

RELATED APPLICATIONS

This application is a continuation of prior U.S. patent application Ser. No. 16/930,533, filed Jul. 17, 2020, which is a continuation of U.S. patent application Ser. No. 16/410,493 filed May 13, 2019, now U.S. Pat. No. 10,721,808, which is a continuation of prior U.S. patent application Ser. No. 15/783,505 filed Oct. 13, 2017, now U.S. Pat. No. 10,342,102, which is a continuation-in-part of prior U.S. patent application Ser. No. 13/868,021 filed Apr. 22, 2013, now U.S. Pat. No. 9,980,350, which is a continuation-in-part of U.S. patent application Ser. No. 13/782,040 filed Mar. 1, 2013, now U.S. Pat. No. 8,975,827, which claims the benefit of U.S. Provisional Application No. 61/738,749 filed Dec. 18, 2012, which is a continuation-in-part of U.S. patent application Ser. No. 13/589,899, now U.S. Pat. No. 10,219,338, and of Ser. No. 13/589,928, now U.S. Pat. No. 10,506,678, each of which was filed Aug. 20, 2012, and each of which claims the benefit of U.S. Provisional Application No. 61/666,920 filed Jul. 1, 2012, the disclosures of all of which are incorporated by reference herein in their entireties.

TECHNICAL FIELD

Embodiments of the present disclosure generally relate to a light fixture configuration module, and in particular to a fixture configuration module that controls a light fixture to produce light within a particular range.

BACKGROUND

In recent years, a movement has gained traction to replace incandescent light bulbs with light fixtures that employ more efficient lighting technologies as well as to replace relatively efficient fluorescent light fixtures with lighting technologies that produce a more pleasing, natural light. One such technology that shows tremendous promise employs light emitting diodes (LEDs). Compared with incandescent bulbs, LED-based light fixtures are much more efficient at converting electrical energy into light, are longer lasting, and are also capable of producing light that is very natural. Compared with fluorescent lighting, LED-based fixtures are also very efficient, but are capable of producing light that is much more natural and more capable of accurately rendering colors. As a result, light fixtures that employ LED technologies are expected to replace incandescent and fluorescent bulbs in residential, commercial, and industrial applications.

Unlike incandescent bulbs that operate by subjecting a filament to a desired current, LED-based light fixtures require electronics to drive one or more LEDs. The electronics generally include a power supply and a special control circuitry to provide uniquely configured signals that are required to drive the one or more LEDs in a desired fashion. The presence of the control circuitry adds a potentially significant level of intelligence to the light fixtures that can be leveraged to employ various types of lighting control.

BRIEF SUMMARY

Various embodiments of the present disclosure are directed to a light fixture, electronics that control a light fixture, a computer readable medium configured with software instructions that (when executed) control a light fixture, and/or methods of controlling a light fixture. Particular embodiments are directed to a fixture configuration module that controls the light fixture to produce light in accordance with particular lighting parameters. Such a fixture configuration module may be removably coupled to the light fixture or may be integrated with the electronics of the light fixture, according to particular embodiments. In some such embodiments, the fixture configuration module controls the light fixture to produce the light in accordance with a stored range for a given lighting parameter. The stored range identifies at least a subset of values of the lighting parameter supported by the light fixture to produce light.

Particular embodiments are directed to a fixture configuration module. The fixture configuration module comprises range control circuitry and fixture control circuitry. The range control circuitry is configured to store a range of a lighting parameter. The range identifies at least a subset of values of the lighting parameter supported by the light fixture to produce light. The fixture control circuitry is communicatively coupled to the range control circuitry and is configured to control the light fixture to produce the light in accordance with the range stored by the range control circuitry.

In some embodiments, the fixture configuration module further comprises user interface circuitry communicatively coupled to the fixture control circuitry independently of the range control circuitry. The user interface circuitry is configured to receive one or more values of the lighting parameter. To control the light fixture to produce the light in accordance with the range, the fixture control circuitry is configured to control the light fixture to produce the light at such values of the lighting parameter received by the user interface circuitry that are within the range stored by the range control circuitry. In some such embodiments, to receive the one or more values of the lighting parameter, the user interface circuitry comprises radio circuitry configured to receive the one or more values of the lighting parameter via radio communication. In some further such embodiments, the radio circuitry is configured to receive a software license enabling remote management of the light fixture, and control the light fixture to produce the light at such values of the lighting parameter received via the radio communication that are within the range stored by the range control circuitry in response.

In some embodiments, the range control circuitry comprises a mechanical switch configured to designate the range of the lighting parameter from a plurality of different ranges by positioning the mechanical switch to one of a plurality of respective switch positions. In some such embodiments, the range control circuitry further comprises near-field communication (NFC) circuitry configured to program the range control circuitry with a range received via NFC signaling, and the plurality of respective switch positions comprises a first position corresponding to the range programmed by the NFC circuitry and a second position corresponding to a different range not programmed by the NFC circuitry. In some further such embodiments, the fixture configuration module further comprises a connector communicatively coupled to the fixture control circuitry. The connector is configured to removably couple with a corresponding connector of the light fixture and transfer electrical power from the light fixture to the fixture control circuitry while the connector is coupled to the corresponding connector of the light fixture. To program the range control circuitry with the range received via the NFC signaling, the NFC circuitry is communicatively coupled to non-volatile memory and further configured to store the range received via the NFC signaling in the non-volatile memory while powered by magnetic induction produced by the NFC signaling and while the connector is decoupled from the corresponding connector of the light fixture. Additionally or alternatively, the range control circuitry further comprises a further mechanical switch, wherein the mechanical switch and further mechanical switch are configured to designate ranges for different respective lighting parameters of the light fixture. In some such embodiments, the ranges for the different respective lighting parameters comprise a color temperature range and a brightness range.

In some embodiments, the fixture configuration module further comprises a mechanical reset button communicatively coupled to the range control circuitry and configured to produce a reset signal. The range control circuitry is configured to override the range of the lighting parameter stored by the range control circuitry with a default range responsive to receiving the reset signal.

Other embodiments are directed to a method of controlling a light fixture. The method is implemented by a fixture configuration module. The method comprises storing a range of a lighting parameter. The range identifies at least a subset of values of the lighting parameter supported by the light fixture to produce light. The method further comprises controlling the light fixture to produce the light in accordance with the stored range.

In some embodiments, controlling the light fixture to produce the light in accordance with the stored range comprises controlling the light fixture to produce the light at such values of the lighting parameter, received by a user interface of the fixture configuration module, that are within the stored range. In some such embodiments, receiving the values of the lighting parameter comprises receiving the values of the lighting parameter via radio communication. In some further such embodiments, the method further comprises receiving a software license enabling remote management of the light fixture, and in response, controlling the light fixture to produce the light at such values of the lighting parameter received via radio communication that are within the stored range.

In some embodiments, the method further comprises designating the range of the lighting parameter from a plurality of different ranges by positioning a mechanical switch of the fixture control module to one of a plurality of respective switch positions. In some such embodiments, the method further comprises programming the fixture configuration module with a range received via near-field communication (NFC) signaling. The plurality of respective switch positions comprises a first position corresponding to the programmed range received via the NFC signaling and a second position corresponding to a different range not received by the NFC circuitry. In some further such embodiments, the method further comprises removably coupling, via a connector of the fixture configuration module, with a corresponding connector of the light fixture, and receiving electrical power from the light fixture in response. Programming the fixture configuration module with the range received via the NFC signaling comprises storing the range received via the NFC signaling in a non-volatile memory of the fixture configuration module while powered by magnetic induction produced by the NFC signaling and while the connector is decoupled from the corresponding connector of the light fixture. Additionally or alternatively, the method further comprises designating a different range of a different lighting parameter of the light fixture using a further mechanical switch of the fixture configuration module. In some such embodiments, the range is a color temperature range of the light fixture, and the different range is a brightness range of the light fixture.

Yet other embodiments are directed to a non-transitory computer readable medium storing software instructions for controlling a programmable fixture configuration module, wherein the software instructions, when executed by processing circuitry of the programmable fixture configuration module, cause the programmable fixture configuration module to perform any of the methods disclosed herein.

Additional embodiments are directed to a light fixture comprising range control circuitry and fixture control circuitry. The range control circuitry is configured to store a range of a lighting parameter. The range identifies at least a subset of values of the lighting parameter supported by the light fixture to produce light. The fixture control circuitry is communicatively coupled to the range control circuitry and is configured to control the light fixture to produce the light in accordance with the range stored by the range control circuitry.

In some embodiments, the light fixture further comprises driver circuitry communicatively coupled to the fixture control circuitry. To control the light fixture to produce the light, the fixture control circuitry is configured to send control signaling to the driver circuitry. The driver circuitry is configured to respond to the control signaling by driving electrical power to solid-state lighting based on the control signaling. In some such embodiments, the light fixture further comprises a printed circuit board on which at least the driver circuitry and the fixture control circuitry are integrated.

DETAILED DESCRIPTION

Figure 1:
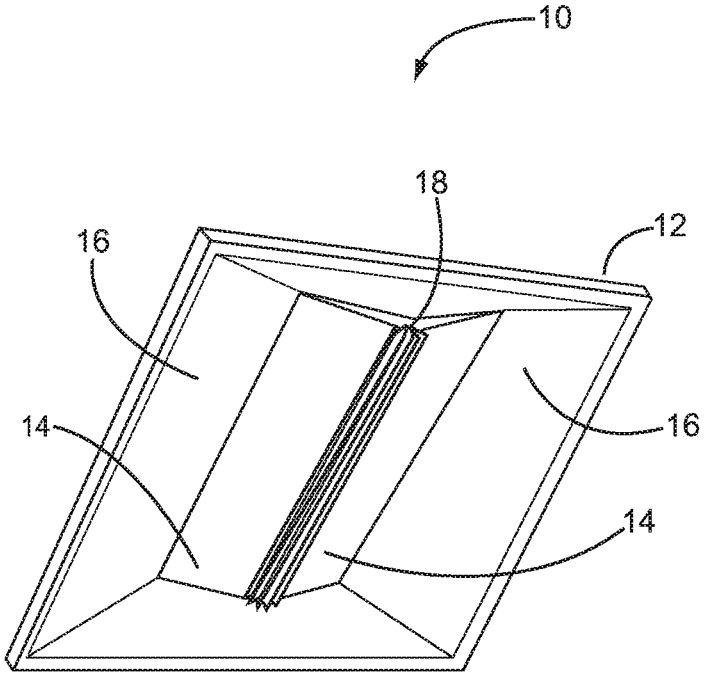
FIG. 1 is a perspective view of a troffer-based light fixture, according to one or more embodiments of the present disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

For clarity in understanding the disclosure below, to the extent that "one of" a conjunctive list of items (e.g., "one of A and B") is discussed, the present disclosure refers to one (but not both) of the items in the list (e.g., an A or a B, but not both A and B). Such a phrase does not refer to one of each of the list items (e.g., one A and one B), nor does such a phrase refer to only one of a single item in the list (e.g., only one A, or only one B). Similarly, to the extent that "at least one of" a conjunctive list of items is discussed (and similarly for "one or more of" such a list), the present disclosure refers to any item in the list or any combination of the items in the list (e.g., an A only, a B only, or both an A and a B). Such a phrase does not refer to at least one of each of the items in the list (e.g., at least one of A and at least one of B).

As will be described in detail below, particular aspects of the present disclosure may be implemented entirely as hardware, entirely as software (including firmware, resident software, micro-code, etc.), or as a combination of hardware and software. For example, embodiments of the present disclosure may take the form of a non-transitory computer readable medium storing software instructions in the form of a computer program that, when executed on a programmable device, configures the programmable device to execute the various methods described below.

As will be discussed in greater detail below, various embodiments of the present disclosure are directed to a light fixture, electronics that control the light fixture, a computer readable medium configured with software instructions that (when executed) control the light fixture, and/or methods of controlling the light fixture. Particular embodiments are directed to a fixture configuration module that controls the light fixture to produce light in accordance with particular lighting parameters. Such a fixture configuration module may be removably coupled to the light fixture or may be integrated with the electronics of the light fixture, according to particular embodiments. FIG. 1 illustrates an example of such a light fixture 10, according to one or more embodiments of the present disclosure.

While the disclosed light fixture 10 illustrated in FIG. 1 employs an indirect lighting configuration wherein light is initially emitted upward from a light source and then reflected downward, direct lighting configurations may also take advantage of the concepts of the present disclosure. In addition to troffer-type light fixtures, the concepts of the present disclosure may also be employed in recessed lighting configurations, wall mount lighting configurations, outdoor lighting configurations, and the like. In particular, the functionality and control techniques described below may be used to control different types of light fixtures, as well as different groups of the same or different types of light fixtures at the same time.

Figure 2:
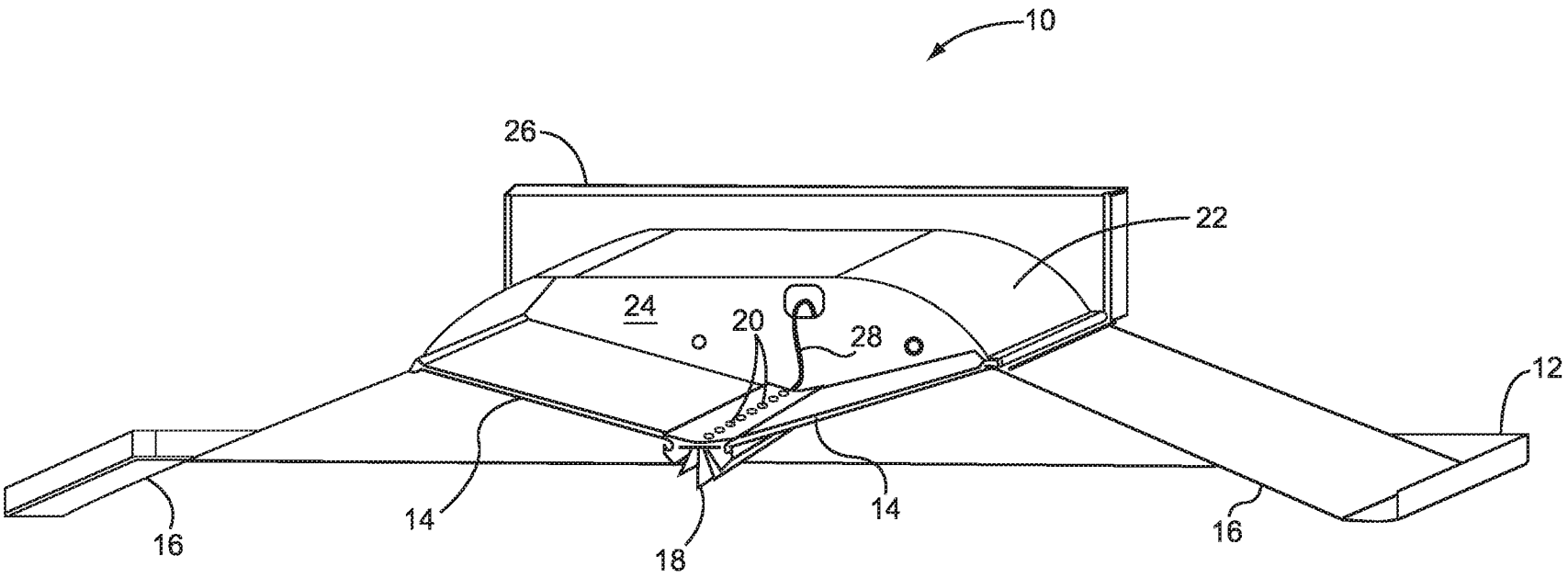
FIG. 2 is a cross section of the light fixture of FIG. 1, according to one or more embodiments of the present disclosure.
Figure 3:
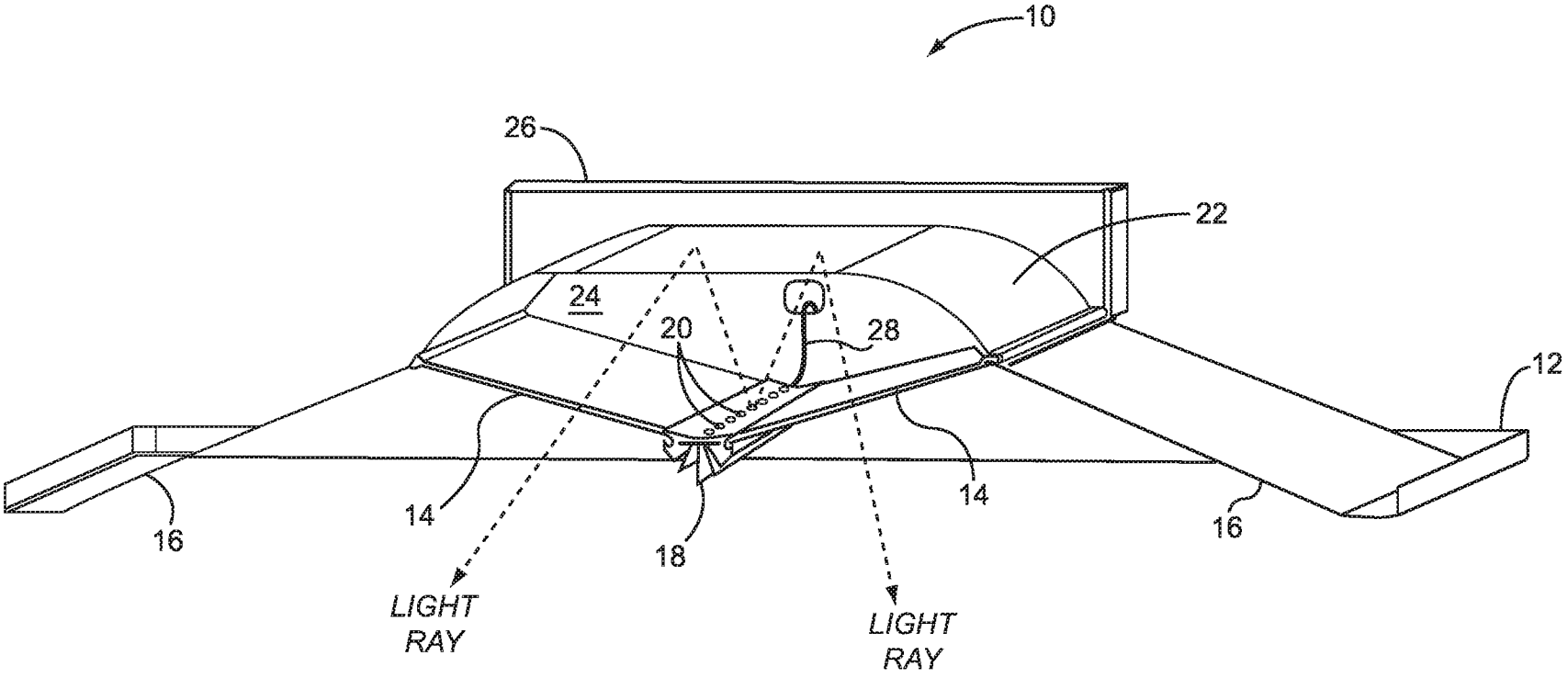
FIG. 3 is a cross section of the light fixture of FIG. 1 illustrating how light emanates from the LEDs of the light fixture and is reflected out through lenses of the light fixture, according to one or more embodiments of the present disclosure.

In general, troffer-type light fixtures, such as the light fixture 10, are designed to mount in a ceiling. In most applications, the troffer-type light fixtures are mounted into a drop ceiling (not shown) of a commercial, educational, or governmental facility. As illustrated in FIGS. 1-3, the light fixture 10 includes a square or rectangular outer frame 12. In the central portion of the light fixture 10 are two rectangular lenses 14, which are generally transparent, translucent, or opaque. Reflectors 16 extend from the outer frame 12 to the outer edges of the lenses 14. The lenses 14 effectively extend between the innermost portions of the reflectors 16 to an elongated heatsink 18, which functions to join the two inside edges of the lenses 14.

Turning now to FIGS. 2 and 3 in particular, the back side of the heatsink 18 provides a mounting structure for an LED array 20, which includes one or more rows of individual LEDs mounted on an appropriate substrate. The LEDs are oriented to primarily emit light upwards toward a concave cover 22. The volume bounded by the cover 22, the lenses 14, and the back of the heatsink 18 provides a mixing chamber 24. As such, light will emanate upwards from the LEDs of the LED array 20 toward the cover 22 and will be reflected downward through the respective lenses 14, as illustrated in FIG. 3. Notably, not all light rays emitted from the LEDs will reflect directly off of the bottom of the cover 22 and back through a particular lens 14 with a single reflection. Many of the light rays will bounce around within the mixing chamber 24 and effectively mix with other light rays, such that a desirably uniform light is emitted through the respective lenses 14.

The type of lenses 14, the type of LEDs, the shape of the cover 22, and any coating on the bottom side of the cover 22, among many other variables, will affect the quantity and quality of light emitted by the light fixture 10. As will be discussed in greater detail below, the LED array 20 may include LEDs of different colors or color temperatures, wherein the light emitted from the various LEDs mixes together to form a white light having a desired color temperature and quality based on the design parameters for the particular embodiment.

As used herein, the term LED may comprise packaged LED chip(s) or unpackaged LED chip(s). LED elements or modules of the same or different types and/or configurations. The LEDs can comprise single or multiple phosphor-converted white and/or color LEDs, and/or bare LED chip(s) mounted separately or together on a single substrate or package that comprises, for example, at least one phosphor-coated LED chip either alone or in combination with at least one color LED chip, such as a green LED, a yellow LED, a red LED, etc. The LED module can comprise phosphor-converted white or color LED chips and/or bare LED chips of the same or different colors mounted directly on a printed circuit board (e.g., chip on board) and/or packaged phosphor-converted white or color LEDs mounted on the printed circuit board, such as a metal core printed circuit board or FR4 board. In some embodiments, the LEDs can be mounted directly to the heat sink or another type of board or substrate. Depending on the embodiment, the lighting device can employ LED arrangements or lighting arrangements using remote phosphor technology as would be understood by one of ordinary skill in the art, and examples of remote phosphor technology are described in U.S. Pat. No. 7,614,759, assigned to the assignee of the present invention and hereby incorporated by reference.

In those cases where a soft white illumination with improved color rendering is to be produced, each LED element or module or a plurality of such elements or modules may include one or more blue shifted yellow LEDs and one or more red or red/orange LEDs as described in U.S. Pat. No. 7,213,940, assigned to the assignee of the present invention and hereby incorporated by reference. In some embodiments, each LED element or module or a plurality of such elements or modules may include one or more blue LEDs with a yellow or green phosphor and one or more blue LEDs with a red phosphor. The LEDs may be disposed in different configurations and/or layouts as desired, for example utilizing single or multiple strings of LEDs where each string of LEDs comprise LED chips in series and/or parallel. Different color temperatures and appearances could be produced using other LED combinations of single and/or multiple LED chips packaged into discrete packages and/or directly mounted to a printed circuit board as a chip-on board arrangement. In one embodiment, the light source comprises any LED, for example, an XP-Q LED incorporating TrueWhite® LED technology or as disclosed in U.S. patent application Ser. No. 13/649,067, filed Oct. 10, 2012, now U.S. Pat. No. 9,818,919, entitled "LED Package with Multiple Element Light Source and Encapsulant Having Planar Surfaces" by Lowes et al., the disclosure of which is hereby incorporated by reference herein, as developed and manufactured by Cree, Inc., the assignee of the present application. If desirable, other LED arrangements are possible. In some embodiments, a string, a group of LEDs or individual LEDs can comprise different lighting characteristics and by independently controlling a string, a group of LEDs or individual LEDs, characteristics of the overall light out output of the device can be controlled.

In some embodiments, each LED element or module may comprise one or more LEDs disposed within a coupling cavity with an air gap being disposed between the LED element or module and a light input surface. In any of the embodiments disclosed herein each of the LED element(s) or module(s) can have different or the same light distribution, although each may have a directional emission distribution (e.g., a side emitting distribution), as necessary or desirable. More generally, any Lambertian, symmetric, wide angle, preferential-sided or asymmetric beam pattern LED element(s) or module(s) may be used as the light source. For example, the LEDs in the fixtures may include LED components having multiple color temperatures.

By providing a lighting fixture that includes a string, a group of LEDs or individual LEDs can comprise different lighting characteristics and by independently controlling a string, a group of LEDs or individual LEDs, characteristics of the overall light out output of the device can be controlled. Traditionally, a single fixture may include multiple stock keeping unit (SKU) identifiers. For example, a particular fixture style may come in a 4000 lumen output model or 5000 lumen output model. For each of those lumen outputs, the fixture may come in a 3000 k correlated color temperature (CCT), 3500 k CCT, 4000 k CCT, or 5000 k CCT. Each of those configurations would have a its own SKU. By using an LED configuration as described above, a single LED fixture having a single SKU can be stocked, and the fixture configuration module described below allows for selecting any of the above listed lumen and/or CCT configurations.

As is apparent from FIGS. 2 and 3, the elongated fins of the heatsink 18 may be visible from the bottom of the light fixture 10. Placing the LEDs of the LED array 20 in thermal contact along the upper side of the heatsink 18 allows heat generated by the LEDs to be effectively transferred to the elongated fins on the bottom side of the heatsink 18 for dissipation within the room in which the light fixture 10 is mounted. Again, the particular configuration of the light fixture 10 illustrated in FIGS. 1-3 is merely one of the virtually limitless configurations for light fixtures 10 in which the concepts of the present disclosure are applicable.

Figure 4:
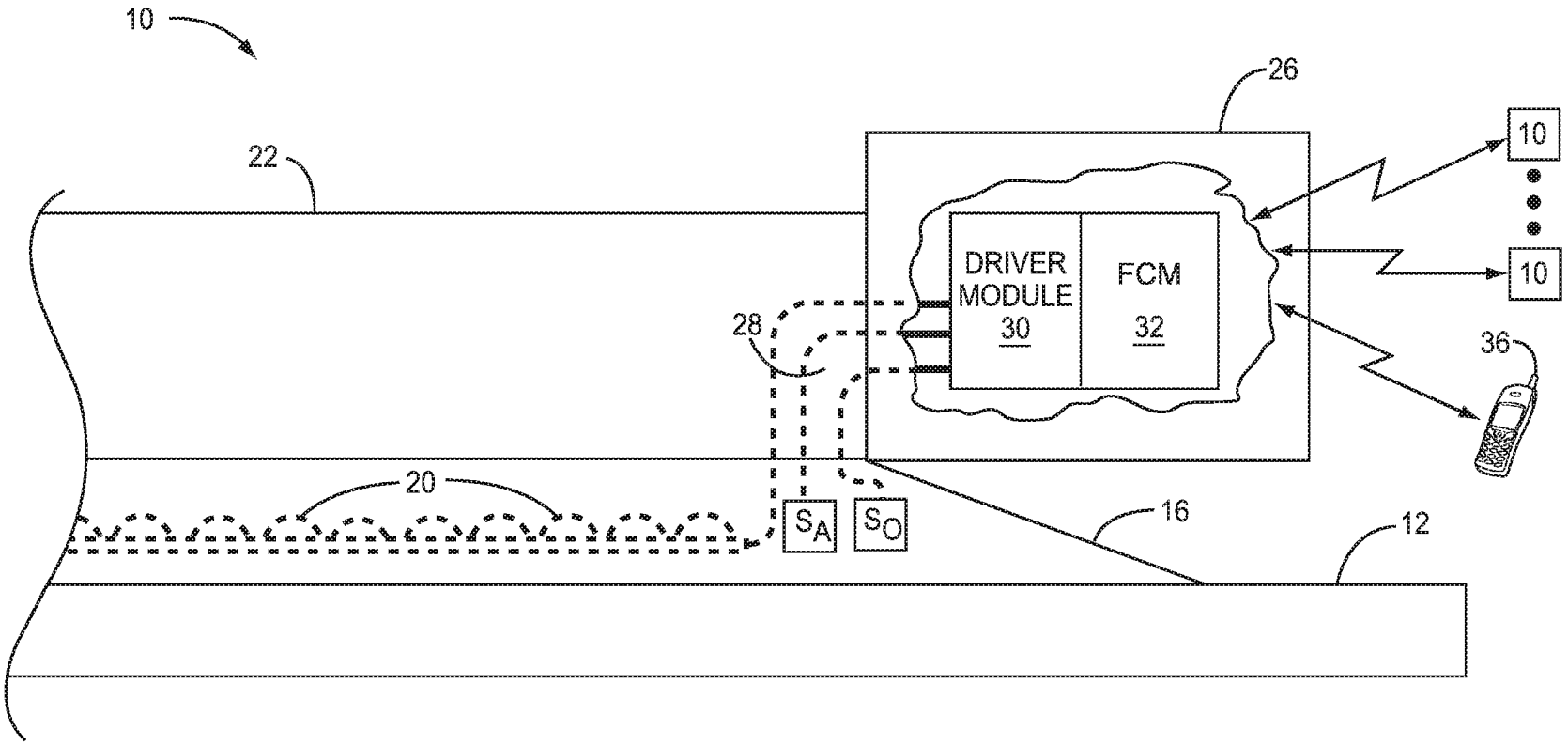
FIG. 4 illustrates a driver module and a fixture configuration module integrated within an electronics housing of the light fixture of FIG. 1, according to one or more embodiments of the present disclosure.

With continued reference to FIGS. 2 and 3, an electronics housing 26 is shown mounted at one end of the light fixture 10, and is used to house all or a portion of the electronics used to power and control the LED array 20. These electronics are coupled to the LED array 20 through appropriate cabling 28. With reference to FIG. 4, the electronics provided in the electronics housing 26 may be divided into a driver module 30 and a fixture configuration module 32.

The driver module 30 is coupled to the LED array 20 through the cabling 28 and directly drives the LEDs of the LED array 20 based on control signaling provided by the fixture configuration module 32. The driver module 30 may be provided on a single, integrated module, may be divided into two or more sub-modules, and/or may be integrated with the fixture configuration module 32, according to various embodiments.

The fixture configuration module 32, in some embodiments, is a communications module that acts as an intelligent communication interface facilitating communications between the driver module 30 and other light fixtures 10, a remote control system (not shown), and/or a portable handheld commissioning tool 36, which may also be configured to communicate with a remote control system in a wired or wireless fashion. The fixture configuration module 32 may additionally or alternatively be a control module that acts as a manual configuration interface facilitating local control of the driver module 30 by a manual user and/or the portable handheld commissioning tool 36 within a limited range.

According to particular embodiments, the fixture configuration module 32 may enforce operating limits on the light fixture 10. That is, the light fixture 10 may support a particular range of values with respect to a given lighting parameter (such as color temperature or brightness), and the fixture configuration module 32 may control the light fixture 10 to produce light in accordance with a range that is a subset of those supported values. For example, the fixture configuration module 32 may limit the light fixture 32 to producing light at color temperatures between 3000K and 4200K, even though the light fixture 10 supports producing light at color temperatures anywhere between 2700K and 5500K. Additionally or alternatively, the fixture configuration module 32 may limit the light fixture 32 to producing light at a lumen level between 2800 lumens and 3100 lumens, even though the light fixture 10 supports producing light at lumen levels anywhere between 1000 lumens and 5000 lumens. One or more of these ranges and/or lighting parameter values may be preprogrammed, field programmable, user-configurable, and/or remotely controllable according to various embodiments, as will be described in greater detail below.

In the embodiment of FIG. 4, the fixture configuration module 32 is implemented on a separate printed circuit board (PCB) than the driver module 30. The respective PCBs of the driver module 30 and the fixture configuration module 32 may be configured to allow the connector of the fixture configuration module 32 to plug into the connector of the driver module 30, wherein the fixture configuration module 32 is mechanically mounted, or affixed, to the driver module 30 once the connector of the fixture configuration module 32 is plugged into the mating connector of the driver module 30.

Other embodiments include arrangements in which the fixture configuration module 32, driver module 30, and/or other electronics of the light fixture 10 are integrated. For example, the fixture configuration module 32 and driver module 30 may be implemented on the same PCB and/or use shared components. In particular, the fixture configuration module 32 and driver module 30 may share one or more microprocessors (not shown in FIG. 4) in order to perform aspects of their respective functions.

In other embodiments, a cable may be used to connect the respective connectors of the driver module 30 and the fixture configuration module 32, other attachment mechanisms may be used to physically couple the fixture configuration module 32 to the driver module 30, or the driver module 30 and the fixture configuration module 32 may be separately affixed to the inside of the electronics housing 26. In such embodiments, the interior of the electronics housing 26 is sized appropriately to accommodate both the driver module 30 and the fixture configuration module 32. In many instances, the electronics housing 26 provides a plenum rated enclosure for both the driver module 30 and the fixture configuration module 32.

Figure 5:
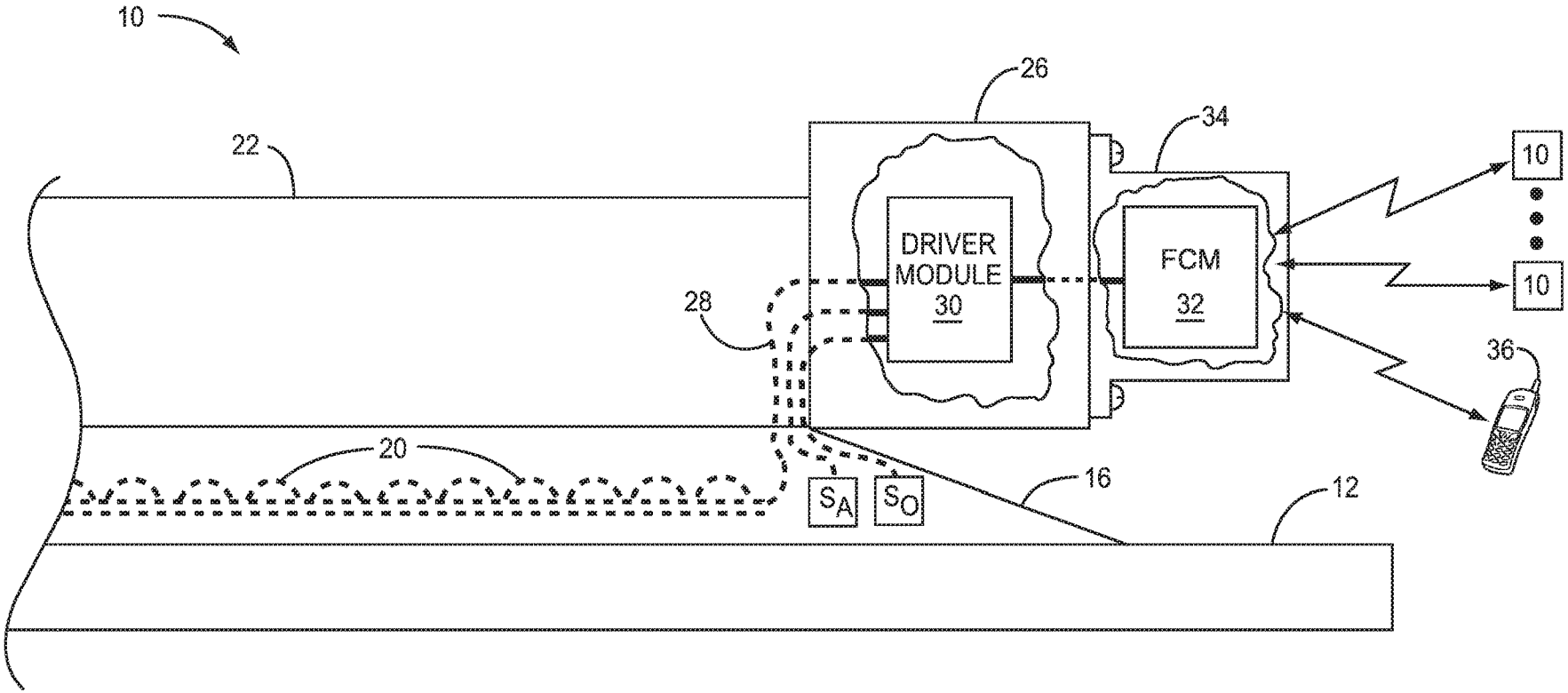
FIG. 5 illustrates a driver module provided in an electronics housing of the light fixture of FIG. 1 and a fixture configuration module in an associated housing coupled to the exterior of the electronics housing, according to one or more embodiments of the present disclosure.

With the embodiment of FIG. 4, adding or replacing the fixture configuration module 32 requires gaining access to the interior of the electronics housing 26. If this is undesirable, the driver module 30 may be provided alone in the electronics housing 26. The fixture configuration module 32 may be mounted outside of the electronics housing 26 in an exposed fashion or within a supplemental housing 34, which may be directly or indirectly coupled to the outside of the electronics housing 26, as shown in FIG. 5. The supplemental housing 34 may be bolted to the electronics housing 26. The supplemental housing 34 may alternatively be connected to the electronics housing using snap-fit or hook-and-snap mechanisms. The supplemental housing 34, alone or when coupled to the exterior surface of the electronics housing 26, may provide a plenum rated enclosure.

In embodiments where the electronics housing 26 and the supplemental housing 34 will be mounted within a plenum rated enclosure, the supplemental housing 34 may not need to be plenum rated. Further, the fixture configuration module 32 may be directly mounted to the exterior of the electronics housing 26 without any need for a supplemental housing 34, depending on the nature of the electronics provided in the fixture configuration module 32, how and where the light fixture 10 will be mounted, and the like. The latter embodiment wherein the fixture configuration module 32 is mounted outside of the electronics housing 26 may prove beneficial when the fixture configuration module 32 facilitates wireless communications with the other light fixtures 10, the remote control system, or other network or auxiliary device. In essence, the driver module 30 may be provided in the plenum rated electronics housing 26, which may not be conducive to wireless communications. The fixture configuration module 32 may be mounted outside of the electronics housing 26 by itself or within the supplemental housing 34 that is more conducive to wireless communications. A cable may be provided between the driver module 30 and the fixture configuration module 32 according to a defined communication interface. As an alternative, which is described in detail further below, the driver module 30 may be equipped with a first connector that is accessible through the wall of the electronics housing 26. The fixture configuration module 32 may have a second connector, which mates with the first connector to facilitate communications between the driver module 30 and the fixture configuration module 32.

The embodiments that employ mounting the fixture configuration module 32 outside of the electronics housing 26 may be somewhat less cost effective, but provide significant flexibility in allowing the fixture configuration module 32 or other auxiliary devices to be added to the light fixture 10, serviced, or replaced. The supplemental housing 34 for the fixture configuration module 32 may be made of a plenum rated plastic or metal, and may be configured to readily mount to the electronics housing 26 through snaps, screws, bolts, or the like, as well as receive the fixture configuration module 32. The fixture configuration module 32 may be mounted to the inside of the supplemental housing 34 through snap-fits, screws, twistlocks, and the like. The cabling and connectors used for connecting the fixture configuration module 32 to the driver module 30 may take any available form, such as with standard category 5 (cat 5) cable having RJ45 connectors, edge card connectors, blind mate connector pairs, terminal blocks and individual wires, and the like. Having an externally mounted fixture configuration module 32 relative to the electronics housing 26 that includes the driver module 30 allows for easy field installation of different types of fixture configuration modules 32, communications modules, or modules with other functionality for a given driver module 30.

As illustrated in FIG. 5, the fixture configuration module 32 is mounted within the supplemental housing 34. In this particular example, the supplemental housing 34 is attached to the electronics housing 26 with bolts. As such, the fixture configuration module 32 is readily attached and removed via the illustrated bolts. In such embodiments, a screwdriver, ratchet, or wrench, depending on the type of head for the bolts, may be required to detach or remove the fixture configuration module 32 via the supplemental housing 34.

Figure 6A:
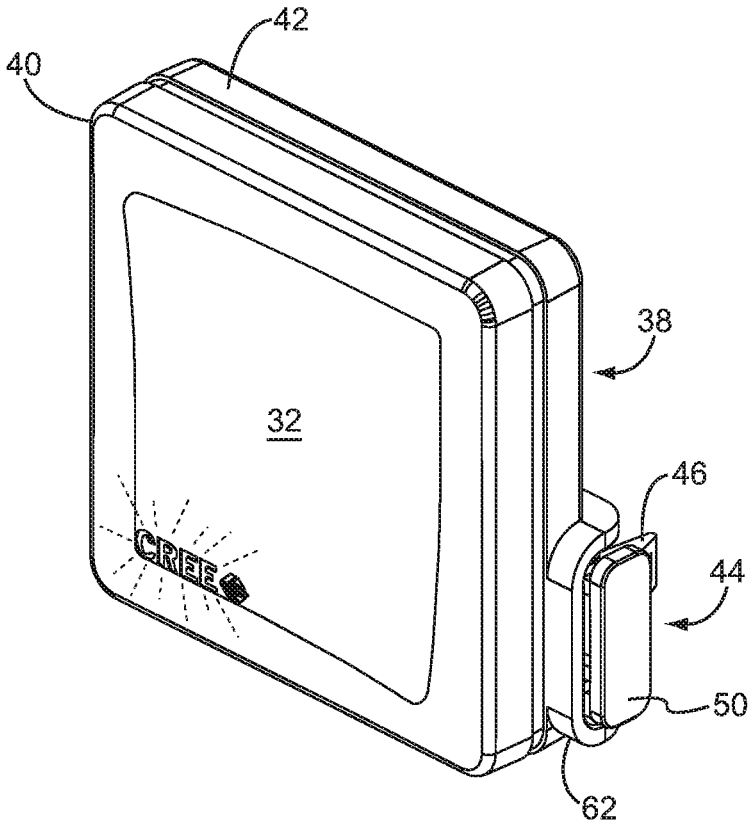
FIGS. 6A and 6B provide front and rear views, respectively, of a fixture configuration module, according to one or more embodiments of the present disclosure.
Figure 6B:
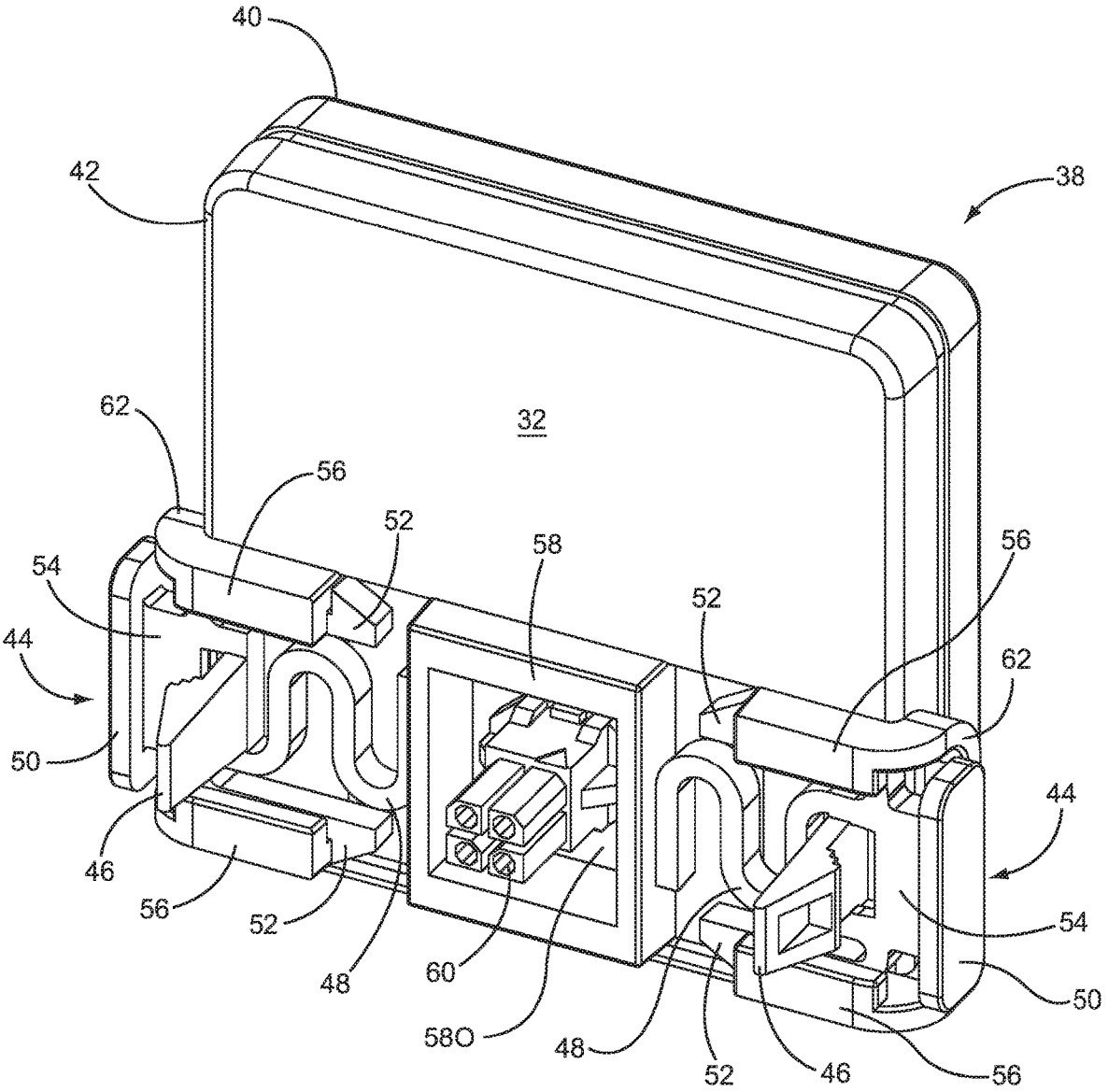

As an alternative, the fixture configuration module 32 may be configured as illustrated in FIGS. 6A and 6B. In this configuration, the fixture configuration module 32 may be attached to the electronics housing 26 of the light fixture 10 in a secure fashion and may subsequently be released from the electronics housing 26 without the need for bolts. In particular, the fixture configuration module 32 may have a two-part module housing 38, which is formed from a front housing section 40 and a rear housing section 42. As will be described further below, the electronics for the fixture configuration module 32 are housed within the module housing 38.

The rear of the module housing 38 illustrated in the example of FIG. 6B includes two snap-lock connectors 44 that are biased to opposing sides of the module housing 38. Each snap-lock connector 44 includes a fixture locking member 46, a spring member 48, a button member 50, and two housing locking members 52. Each of the fixture locking member 46, the spring member 48, the button member 50, and the housing locking members 52 essentially extend from a central body portion 54 in the illustrated embodiment.

The rear housing section 42 is provided with two pairs of elongated channel guides 56. Each pair of the channel guides 56 are biased toward the outside of the rear housing section 42, and form a channel, which will receive the snap-lock connector 44. Once the snap-lock connectors 44 are extended far enough into the channel formed by the pair of channel guides 56, barbs on the housing locking members 52 will engage the inside surfaces of the channel guides 56 and effectively lock the snap-lock connectors 44 in place in the channel formed by the channel guides 56.

Also located on the outside surface of the rear housing section 42 is a flame barrier 58, which is configured to surround an opening 580 that extends into the module housing 38. A connector 60, which provides an electrical interface to the electronics of the fixture configuration module 32, extends into or through the opening 580. In the illustrated embodiment, the flame barrier 58 is a continuous wall that surrounds the opening 580 and extends from the exterior surface of the rear housing section 42. The flame barrier 58 is square, but may form a perimeter of any desired shape. The flame barrier 58 is configured to mate flush against the electronics housing 26 of the light fixture 10 or a mating component provided thereon. The channel guides 56 may extend to and form part of a connector rim 62, which effectively provides an aesthetically pleasing recess in which the button member 50 of the snap-lock connector 44 may reside.

Figure 7:
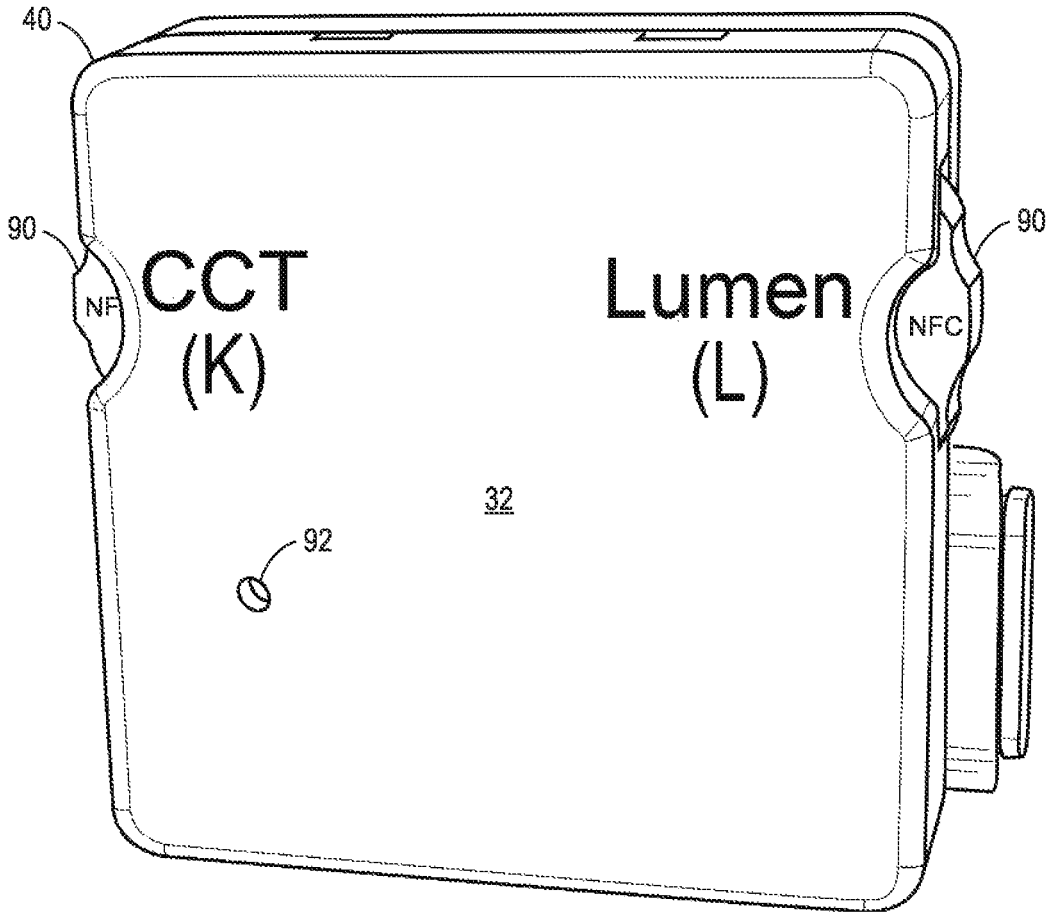
FIG. 7 provides a front view of another fixture configuration module, according to one or more embodiments of the present disclosure.

As shown in FIG. 7, the fixture configuration module 32 may further comprise one or more mechanical switches 90, each of which may be positioned to one of a plurality of switch positions. Positioning a mechanical switch 90 to one of the switch positions may designate one of a plurality of ranges to which a corresponding lighting parameter of the light fixture 10 will be limited by the fixture configuration module 32.

In the particular example illustrated in FIG. 7, the fixture configuration module comprises mechanical switches 90 in the form of rotary dials, each of which may be rotated through a plurality of different positions, each position corresponding to a different range. Other embodiments may additionally or alternatively include one or more other types of mechanical switches 90, including (but not limited to) pushbutton switches, rocker switches, tactile switches, dipswitches, proximity switches, slide switches, toggle switches, and/or snap switches.

The particular mechanical switches 90 illustrated in FIG. 7 are configured to designate ranges for different respective lighting parameters of the light fixture 10, namely, CCT level and lumen level. Other embodiments of the fixture configuration module 32 include mechanical switches 90 used for other purposes. For example, according to embodiments, a mechanical switch 90 may be used to locally set a value of a lighting parameter of the light fixture 10. In some embodiments, the locally set value may be a maximum or minimum value for the light fixture 10 (e.g., a maximum color temperature of 5000K, a minimum brightness of 1000 lumens). In other embodiments, the locally set value may be a value at which the fixture configuration module 32 controls the light fixture 10 to produce light (e.g., an actual color temperature of light desired from the light fixture 10).

The lighting parameter to which each switch corresponds may be formed and/or printed on the front housing section 40, as shown in FIG. 7. Each of the mechanical switches 90 in the example of FIG. 7 is set to a position corresponding to a range programmed via near-field communication (NFC), as depicted by the NFC label on the exposed face of each dial. In some other embodiments, the fixture configuration module 32 interprets the setting of any of the mechanical switches 90 to the NFC position as an instruction to use whatever NFC programmed ranges have been stored for each of the lighting parameters associated with the mechanical switches 90. For example, in response to a first mechanical switch being set to the NFC position, and a second mechanical switch being set to a non-NFC position, the fixture configuration module 32 may be configured to apply NFC programmed ranges to the lighting parameters associated with both of the mechanical switches 90. Alternatively, in some embodiments, only one of a plurality of mechanical switches 90 has an NFC position, and the fixture configuration module 32 is configured to apply whichever programmed ranges as the fixture configuration module 32 may have stored in association with the NFC setting in response to the NFC position being used.

Other embodiments of the fixture configuration module 32 additionally or alternatively include a mechanical reset button accessed through a hole 92 in the front section housing 40. The hole 92 may be sized such that actuation of the mechanical reset button may require insertion of a thin tool (e.g., paperclip, thumbtack, toothpick) as a safety measure against accidentally resetting the fixture configuration module 32. In particular, the mechanical reset button may be configured to produce a reset signal upon actuation. This reset signal may cause the fixture configuration module 32 to override one or more of the ranges used by the fixture configuration module 32 to limit operation of the light fixture 10, as will be discussed further below. Other embodiments may include a reset button that is mounted to the front housing section 40 such that a user may actuate the reset button without the use of a tool.

Other embodiments may have additional or alternative input mechanisms, any or all of which may be mechanical and/or electronic in nature. Further details concerning the mechanical inputs and electronics of the fixture configuration module 32 according to various embodiments will be discussed in greater detail below.

Figure 8A:
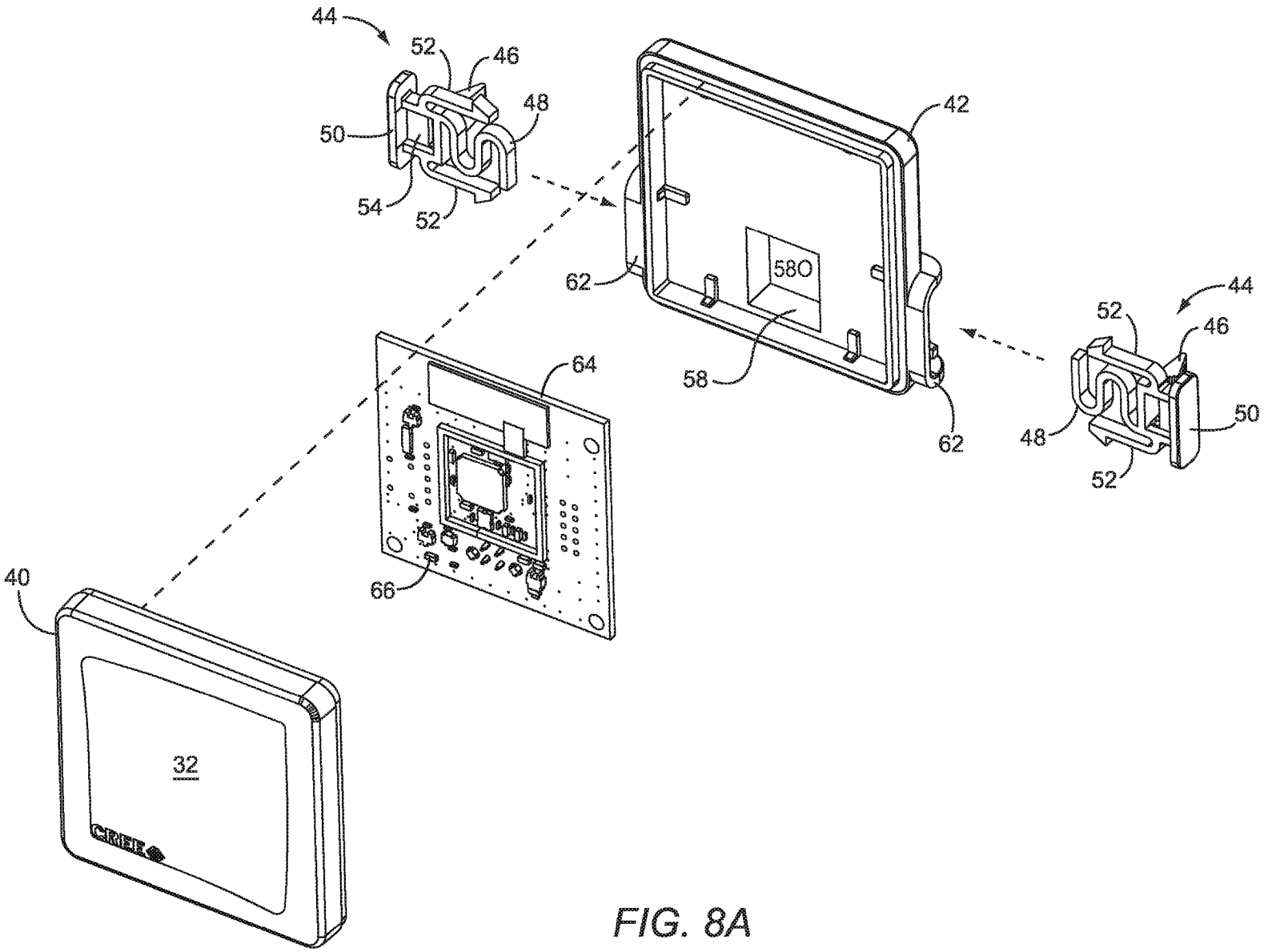
FIGS. 8A and 8B respectively illustrate front and rear exploded views of the fixture configuration module, according to one or more embodiments of the present disclosure.
Figure 8B:
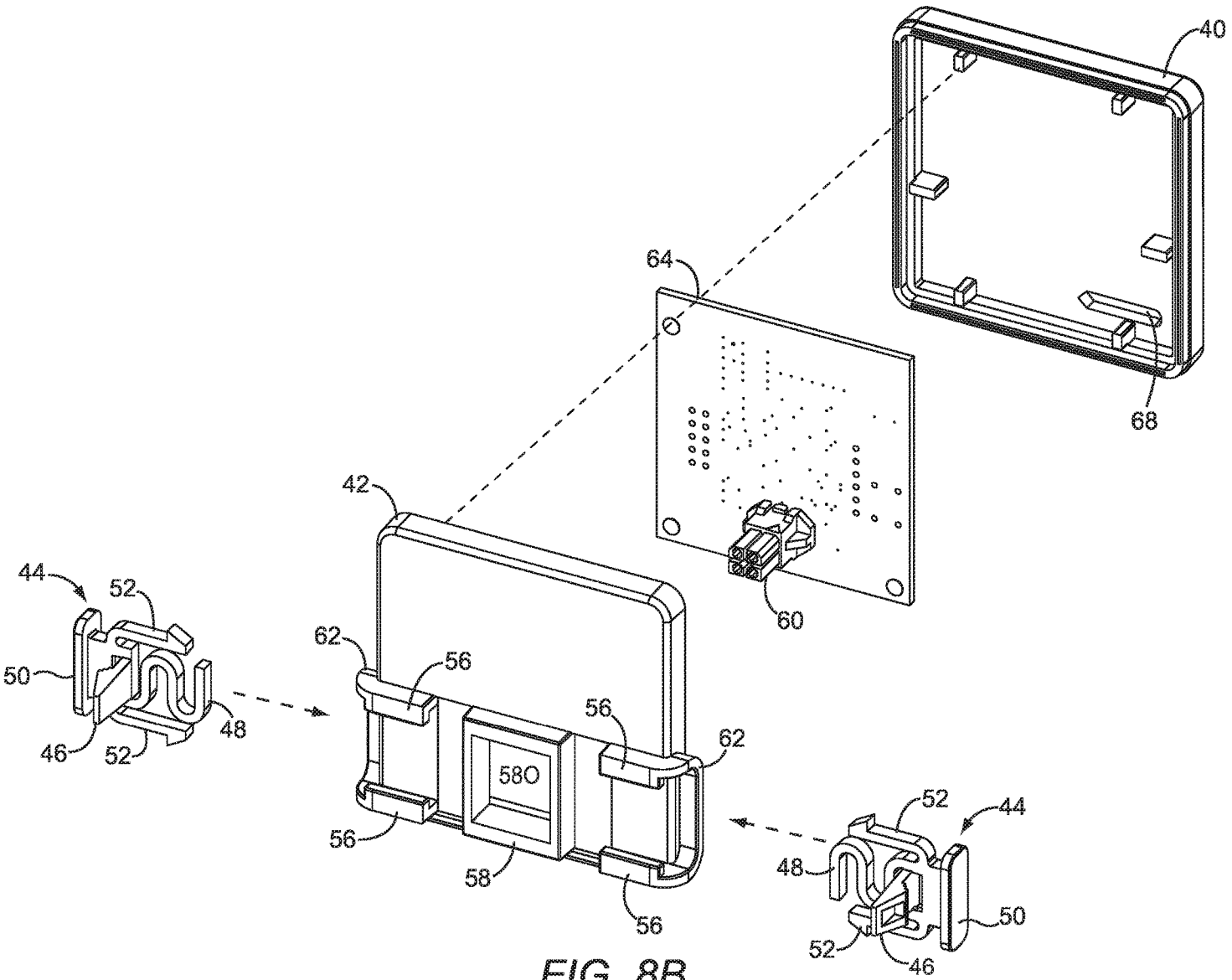

Turning now to FIGS. 8A and 8B, front and back exploded perspective views of an exemplary snap-lock connector 44 are shown. As illustrated, the front housing section 40 and the rear housing section 42 mate together to enclose a printed circuit board (PCB) 64, which includes the requisite electronics of the fixture configuration module 32. On the side of the PCB 64 where most of the electronic components are mounted, the aforementioned reset button 66 may be mounted. On the opposite side of the PCB 64, the connector 60 is mounted in a location that allows it to extend into and partially through the opening 580.

The front housing section 40 and the rear housing section 42 may be formed from a variety of materials, such as fiberglass, thermoplastics, metal, and the like. In this instance, the front housing section 40 is formed from a thermoplastic. As illustrated in FIG. 8A, a logo may be formed or printed on the exterior surface of the front housing section 40.

Also illustrated in FIGS. 8A and 8B are the snap-lock connectors 44 prior to being inserted into the respective channels formed by the channel guides 56. As each snap-lock connector 44 is inserted into the channel formed by the pair of channel guides 56, barbs of the housing locking members 52 contact the opening of the channel and are deflected inward toward one another. Each snap-lock connector 44 is pushed into and through the corresponding channel until the rear of the barbs pass the back of the channel guides 56. Once the rear of the barbs pass the rear of the channel guides 56, the housing locking members 52 will spring outward toward their normal resting state, thus locking the snap-lock connector 44 in place against the back of the rear housing section 42. To remove the snap-lock connector 44, the housing locking members 52 need to be deflected inward, while the snap-lock connector 44 is pulled back out through the channel formed by the channel guides 56.

When the snap-lock connectors 44 are in place, the free end of the spring member 48 rests against a proximate side of the flame barrier 58. When the snap-lock connector 44 is in place, the spring member 48 may be slightly compressed or not compressed at all. As such, the spring member 48 effectively biases the snap-lock connector 44 in an outward direction through the channels formed by the respective pairs of channel guides 56. In essence, pressing and releasing the button member 50 of the snap-lock connector 44 moves the fixture locking member 46 inward and then outward. If a user applies pressure inward on the button member 50 and thus presses the snap-lock connector 44 inward, the spring member 48 will further compress. When the pressure is released, the spring member 48 will push the snap-lock connector 44 back into its normal resting position. As will be described below, pressing both of the snap-lock connectors 44 inward via the button members 50 will effectively disengage the communications module 32 from the electronics housing 26 of the light fixture 10.

Figure 9A:
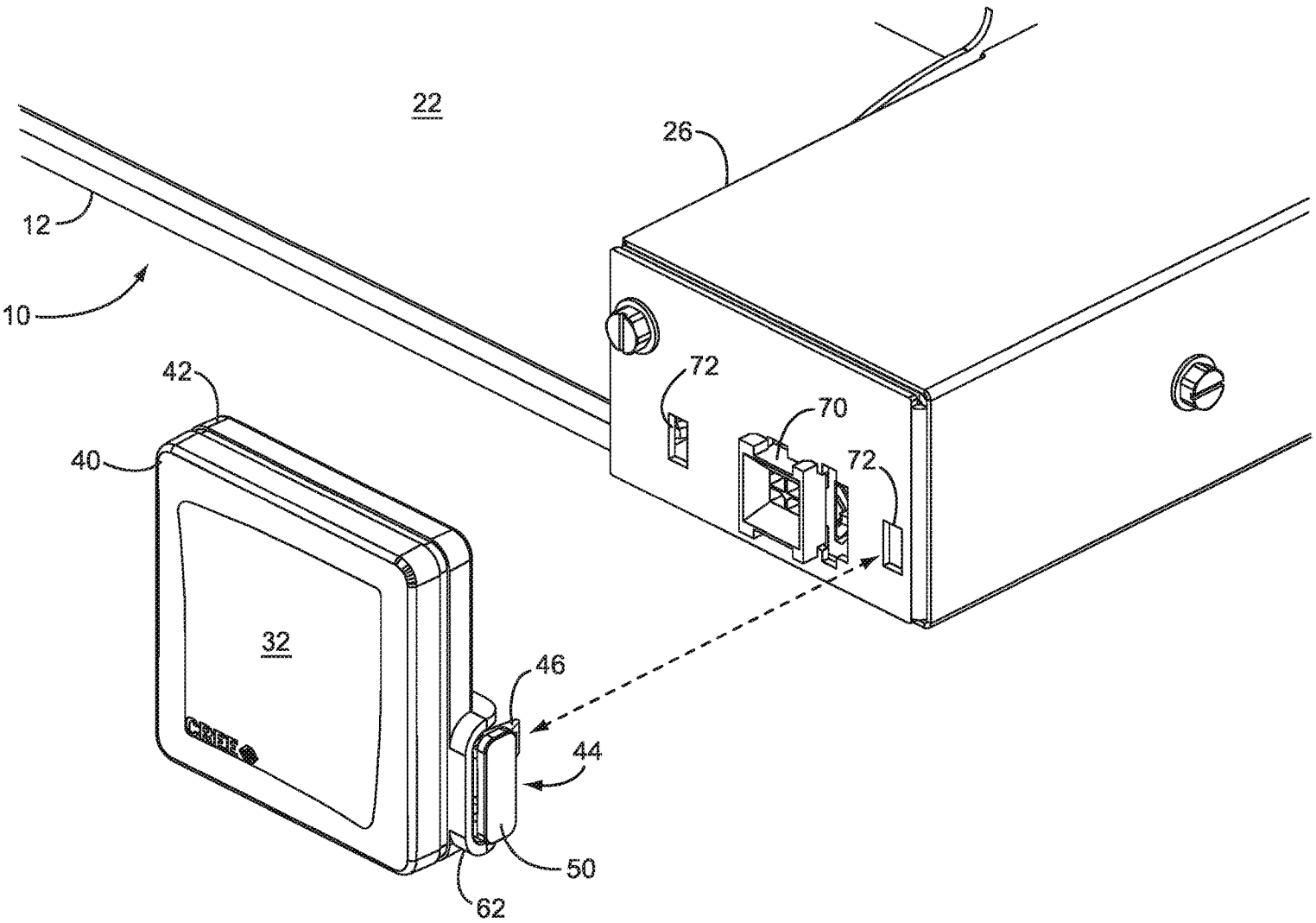
FIGS. 9A and 9B respectively illustrate the fixture configuration module before and after being attached to the housing of the light fixture, according to one or more embodiments of the present disclosure.

FIG. 9A illustrates the fixture configuration module 32 prior to being attached to or just after being released from the electronics housing 26 of the light fixture 10. As illustrated, one surface of the electronics housing 26 of the light fixture 10 includes two locking interfaces 72, which are essentially openings into the electronics housing 26 of the light fixture 10. The openings for the locking interfaces 72 correspond in size and location to the fixture locking members 46. Further, a connector 70 that leads to or is coupled to a PCB of the electronics for the driver module 30 is provided between the openings of the locking interfaces 72. In this example, the connector 60 of the fixture configuration module 32 is a male connector that is configured to be received by the female connector 70, which is mounted on the electronics housing 26 of the light fixture 10.

Figure 9B:
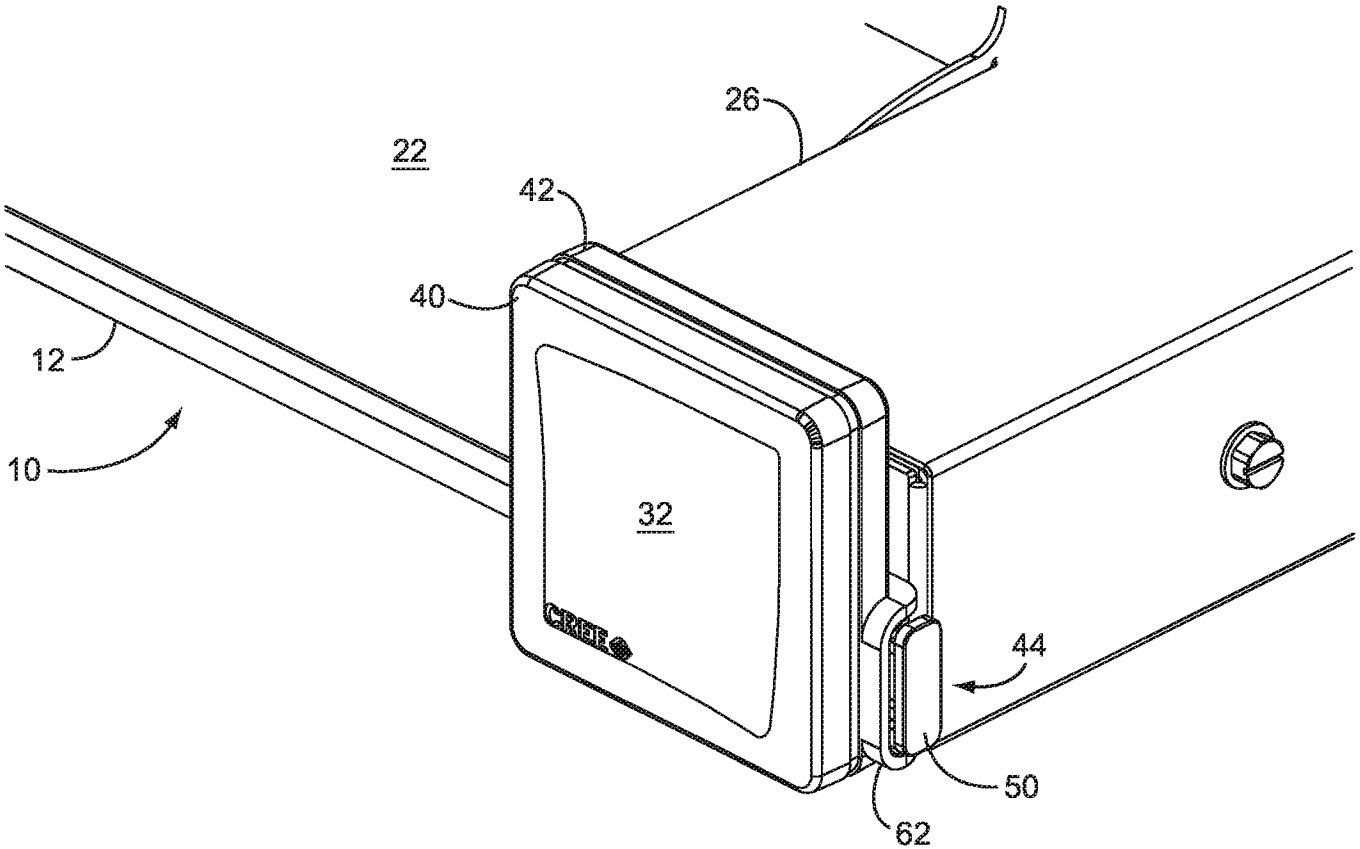

As the fixture configuration module 32 is snapped into place on the electronics housing 26 of the light fixture 10, as illustrated in FIG. 9B, the male connector 60 of the fixture configuration module 32 will engage the female connector 70 of the driver module 30 as the fixture locking members 46 engage the respective openings of the locking interfaces 72. In particular, when the barbs of the fixture locking members 46 engage the respective openings of the locking interfaces 72, the fixture locking members 46 will deflect inward until the rear portion of the barbs pass the rear surface of the wall for the electronics housing 26. At this point, the fixture locking members 46 will move outward, such that the rear portions of the barbs engage the rear surface of the wall of the electronics housing 26. At this point, the fixture configuration module 32 is snapped into place to the electronics housing 26 of the lighting fixture 10, and the connectors 60 and 70 of the fixture configuration module 32 and the driver module 30 are fully engaged.

The fixture configuration module 32 may be readily released from the electronics housing 26 by pressing both of the snap-lock connectors 44 inward via the button members 50 and then pulling the fixture configuration module 32 away from the electronics housing 26 of the light fixture 10. Pressing the snap-lock connectors 44 inward effectively moves the barbs inward and into the respective openings of the locking interfaces 72, such that they can readily slide out of the respective openings of the locking interfaces 72. Thus, the fixture configuration module 32 may be readily attached and removed from the electronics housing 26 in a fluid and ergonomic fashion, without the need for additional tools. In the illustrated embodiment, the flame barrier 58 rests securely against the exterior surface of the electronics housing 26 of the lighting fixture 10 and acts to seal off the connector interface for the connectors 60 and 70. Thus, the flame barrier 58 may provide a plenum flame barrier for the connector interface and the electronics housed within the fixture configuration module 32.

According to various embodiments, modules of any type of capability may be configured in the same manner as one or more embodiments of the fixture configuration module 32 described herein. Thus, any number of modules that provide one or more special functions may be housed in a similar housing and connected to the driver module 30. According to such embodiments, the functionality provided by the electronics within the housing 34 may vary in order to provide the desired functionality. For example, such modules may be used to provide one or more functions, such as wireless communications, occupancy sensing, ambient light sensing, temperature sensing, emergency lighting operation, and the like.

Figure 10:
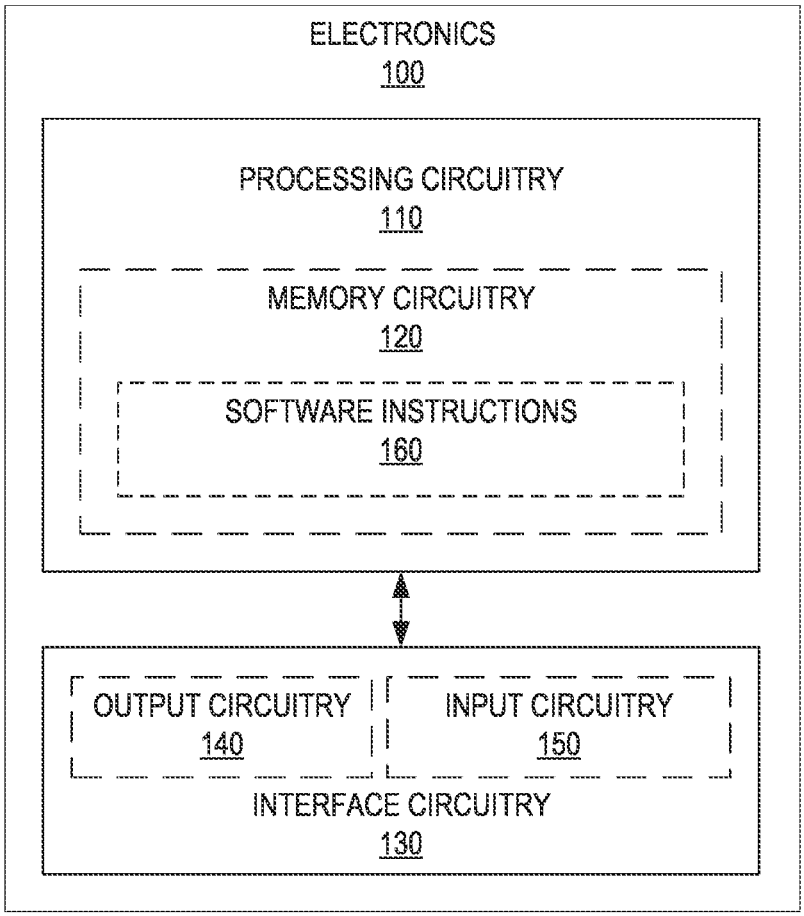
FIG. 10 is a block diagram illustrating an example of electronics of a fixture configuration module, according to one or more embodiments of the present disclosure.

FIG. 10 illustrates example electronics 100 of the fixture configuration module 32. The electronics 100 comprises processing circuitry 110 and interface circuitry 130. The processing circuitry 110 is communicatively coupled to the interface circuitry 130, e.g., via one or more buses. The processing circuitry 110 may comprise one or more microprocessors, microcontrollers, hardware circuits, discrete logic circuits, hardware registers, digital signal processors (DSPs), field-programmable gate arrays (FPGAs), application-specific integrated circuits (ASICs), or a combination thereof. For example, the processing circuitry 110 may be programmable hardware capable of executing software instructions 160 stored, e.g., as a machine-readable computer program in memory circuitry 120 of the processing circuitry 110. Such memory circuitry 120 may comprise any non-transitory machine-readable media known in the art or that may be developed, whether volatile or non-volatile, including but not limited to solid state media (e.g., SRAM, DRAM, DDRAM, ROM, PROM, EPROM, flash memory, solid state drive, etc.), removable storage devices (e.g., Secure Digital (SD) card, miniSD card, microSD card, memory stick, thumb-drive, USB flash drive, ROM cartridge, Universal Media Disc), fixed drive (e.g., magnetic hard disk drive), or the like, wholly or in any combination.

The interface circuitry 130 may be a controller hub configured to control the input and output (I/O) data paths of the electronics 100. Such I/O data paths may include data paths for wirelessly exchanging signals with local devices and/or over a communications network. Such I/O data paths may additionally or alternatively include one or more buses (e.g., an I2C bus) for exchanging signaling with a light fixture 10. Such data paths may additionally or alternatively include data paths for exchanging signals with mechanical switches 90 and/or buttons for receiving input from a user.

In particular, the interface circuitry 130 may comprise one or more transceivers, each of which may be configured to send and receive communication signals over a particular radio access technology. For example, the interface circuitry may comprise a far-field radio transceiver for communicating with one or more devices on a wireless local area network (WLAN) and/or an NFC transceiver for communicating with a nearby device (e.g., the commissioning tool 36) via NFC signaling. Other embodiments additionally or alternatively include one or more other forms of transceivers configured to send and receive communication signals over one or more of a wireless medium, wired medium, electrical medium, electromagnetic medium, and/or optical medium. Examples of such transceivers include (but are not limited to) BLUETOOTH, ZIGBEE, optical, and/or acoustic transceivers.

The interface circuitry 130 may also comprise one or more mechanical switches 90, buttons, graphics adapters, display ports, video buses, touchscreens, graphical processing units (GPUs), Liquid Crystal Displays (LCDs), and/or LED displays, for presenting visual information to a user. The interface circuitry 130 may also comprise one or more pointing devices (e.g., a mouse, stylus, touchpad, trackball, pointing stick, joystick), touchscreens, microphones for speech input, optical sensors for optical recognition of gestures, and/or keyboards for text entry.

The interface circuitry 130 may be implemented as a unitary physical component, or as a plurality of physical components that are contiguously or separately arranged, any of which may be communicatively coupled to any other, may communicate with any other via the processing circuitry 110, or may be independently coupled to the processing circuitry 110 without the ability to communicate with one or more other components, according to particular embodiments. For example, the interface circuitry 130 may comprise output circuitry 140 (e.g., an I2C bus configured to exchange signals with the light fixture 10) and input circuitry 150 (e.g., receiver circuitry configured to receive communication signals over WLAN and/or NFC signaling). Similarly, the output circuitry 540 may comprise a WLAN transmitter, whereas the input circuitry 550 may comprise one or more mechanical switches 90. Other examples, permutations, and arrangements of the above and their equivalents are included according to various aspects of the present disclosure.

Figure 11:
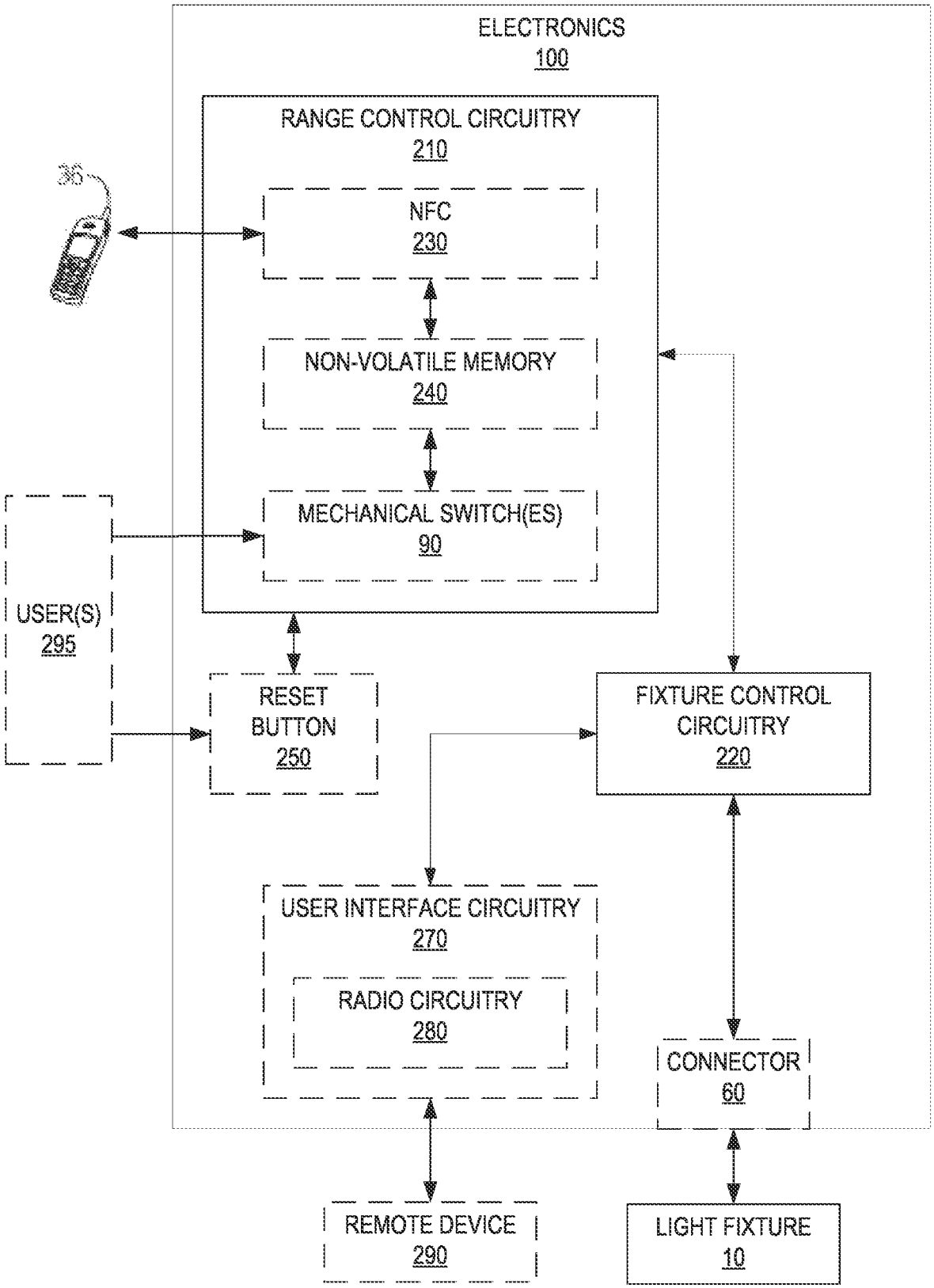
FIG. 11 is a block diagram illustrating another example of electronics of a fixture configuration module, according to one or more embodiments of the present disclosure.

Other embodiments of the electronics 100 of the fixture configuration module 32 may be configured according to the example illustrated in FIG. 11. As shown, the electronics 100 are configured to exchange signaling with a light fixture 10, and may additionally send and/or receive signaling from a commissioning tool 36, one or more users 295, and/or a remote device 295, as will be discussed in further detail below.

The electronics 100 in the example of FIG. 11 comprise range control circuitry 210 and fixture control circuitry 220 communicatively coupled to the range control circuitry 210. The range control circuitry 210 is configured to store a range of a lighting parameter. The range identifies at least a subset of values of the lighting parameter supported by a light fixture 10 to produce light. The fixture control circuitry 220 is configured to control the light fixture 10 to produce the light in accordance with the range stored by the range control circuitry 210.

In some embodiments, the range control circuitry 210 comprises a mechanical switch 90 configured to designate such a range from a plurality of different ranges by positioning the mechanical switch 90 to one of a plurality of respective switch positions. For example, the lighting parameter to which the range pertains may be color temperature, and a user 295 may position the mechanical switch 90 to a first position to designate a "cool white" range of, e.g., 3100K to 4500K, whereas positioning the mechanical switch 90 to a second position may designate a "warm white" range of, e.g., 2000K to 3000K. Other ranges, including ranges that may overlap, may be designated according to other embodiments and may be based on the particular lighting parameter to be limited using the range control circuitry 210. Other embodiments may further comprise a further mechanical switch 90 configured to designate another range for a different lighting parameter of the light fixture, such as brightness, as mentioned above.

In some embodiments, the range may be programmed in the range control circuitry 210 by the commissioning tool 36. In particular, the range control circuitry 210 may include a transceiver with which to exchange signaling with the commissioning tool 36 in order to receive the range. In the particular example illustrated in FIG. 7, the range control circuitry 210 comprises NFC circuitry 230 configured to program the range control circuitry 210 with a range received via NFC signaling. In some embodiments, to program the range control circuitry 210 with the range received via the NFC signaling, the NFC circuitry 230 is communicatively coupled to non-volatile memory 240, and is further configured to store the range received via the NFC signaling in the non-volatile memory 240. In particular, the NFC circuitry 230 may store the range received via the NFC signaling in the non-volatile memory 240 while powered by magnetic induction produced by the NFC signaling. In at least some embodiments, this permits the range to be programmed in the range control circuitry 210 regardless of whether the fixture configuration module 32 is coupled to or decoupled from the light fixture 10. Indeed, the ability to program the fixture configuration module 32 while decoupled from the light fixture 10 may be advantageous for customizing the fixture configuration module 32 during the manufacturing, packaging, and/or shipping process. For example, according to some such embodiments, the fixture configuration may be wirelessly programmed via NFC signaling before being shipped to a customer site where the light fixture 10 to be controlled is already installed.

According to particular embodiments, the fixture control circuitry 220 may be configured to transfer a range from the range control circuitry 210 to the light fixture 10, such that the light fixture 10 may enforce the range with respect to a particular lighting parameter regardless of whether or not the fixture configuration module 32 is subsequently decoupled from the light fixture 10. This may, for example, enable a user 295 to briefly couple the same fixture configuration module 32 to each of a plurality of light fixtures 10 in order to limit the range of operation of each. According to other embodiments, the fixture control module may refrain from transferring the range to the light fixture 10, such that the light fixture 10 is no longer limited to a range stored by the range control circuitry 210 once the fixture configuration module 32 is decoupled.

In at least some embodiments in which the range control circuitry 210 comprises a mechanical switch 90, the range received via NFC signaling may be designated by positioning the mechanical switch 90 to a given position. Further, in some such embodiments, positioning the mechanical switch 90 in one or more other positions may designate other respective ranges not programmed by the NFC circuitry 230. Thus, a user 295 may, e.g., use the mechanical switch 90 to set the range to the range programmed via NFC signaling or to a predefined range (e.g., programmed in a read only memory (ROM) or other form of non-volatile memory 240), as desired.

As discussed above, the electronics 100 may, in some embodiments, comprise a connector 60 communicatively coupled to the fixture control circuitry and configured to removably couple with a corresponding connector 70 of the light fixture 10. In some embodiments, the connector 60 of the fixture configuration module 32 transfers electrical power from the light fixture 10 to the fixture control circuitry 220 while they are coupled via the connector 60. The connector 60 may additionally or alternatively transfer control signaling between the fixture control circuitry 220 and the light fixture 10.

In some embodiments, the electronics 100 further comprise user interface circuitry 270 that is communicatively coupled to the fixture control circuitry 220, independently of the range control circuitry 210. For example, the range control circuitry 210 and user interface circuitry may comprise respective communication circuitry (e.g., NFC circuitry 210 and radio circuitry 280), each of which is separately and distinctly connected to the fixture control circuitry 220 (e.g., via separate respective buses).

According to embodiments, the user interface circuitry 270 is configured to receive one or more values of the lighting parameter (e.g., via one or more of the input mechanisms described above). In particular, the user interface circuitry 270 may comprise radio circuitry 280, e.g., to permit remote management of the light fixture 10 by a remote device 290 (such as a workstation, laptop, or server connected by direct wireless connection or via a network to the fixture configuration module 32). In such embodiments, the fixture control circuitry 220 may be configured to control the light fixture to produce the light at such values of the lighting parameter received by the user interface circuitry 270 that are within the range stored by the range control circuitry 210 (e.g., and reject or ignore such values of the lighting parameter received by the user interface circuitry 270 that are not within such range, according to some embodiments).

In some embodiments, the remote management features discussed above may require a separate software license in order to be enabled in the user interface circuitry 270. For example, the radio circuitry 280 may be configured to receive a software license from the remote device 290, and in response, enable a command interface through which the values of the lighting parameter may be received. According to some such embodiments, the absence, expiration, invalidation, and/or cancellation of the software license may disable the remote management features. Nonetheless, the range control circuitry 210 and fixture control circuitry 220 may continue to operate as previously described.

In some embodiments, the electronics 100 may further comprise a mechanical reset button 250 that is communicatively coupled to the range control circuitry 210 and is configured to produce a reset signal. In such embodiments, the range control circuitry 210 may be configured to override the range of the lighting parameter stored by the range control circuitry 210 with a default range (e.g., a factory default range) responsive to receiving the reset signal.

It should be noted that any or all of the electronics 100 described above may, in particular embodiments, be electronically integrated with each other and/or may be electronically integrated with some or all further electronics of the light fixture, e.g., on one or more PCBs. According to particular embodiments circuitry of the driver module 30 and the fixture control circuitry 220 are electronically integrated.

Figure 12:
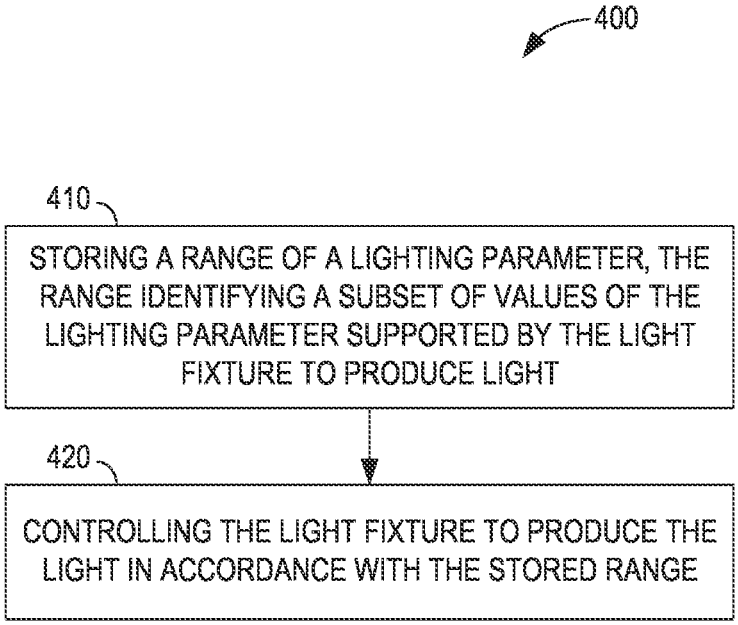
FIG. 12 is a flow diagram illustrating an example method implemented by a fixture configuration module, according to one or more embodiments of the present disclosure.

In view of the above, particular embodiments of the present disclosure include various methods of controlling a light fixture 10 implemented by a fixture configuration module 32. An example of such a method 400 is illustrated in FIG. 12. The method 400 comprises storing a range of a lighting parameter (block 410). The range identifies at least a subset of values of the lighting parameter supported by the light fixture 10 to produce light. The method 400 further comprises controlling the light fixture 10 to produce the light in accordance with the stored range (block 420).

Figure 13:
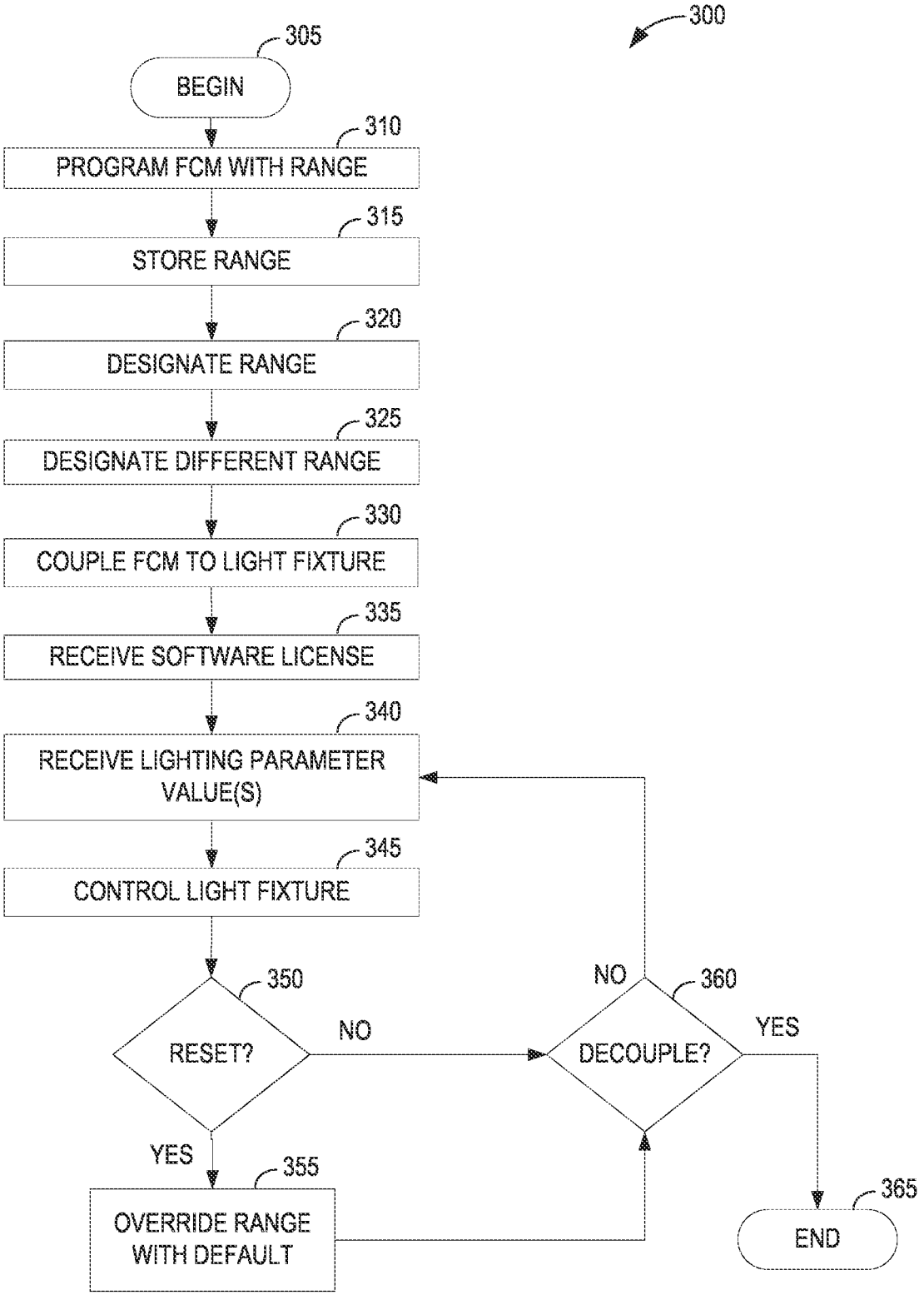
FIG. 13 is a flow diagram illustrating a more detailed example method implemented by a fixture configuration module, according to one or more embodiments of the present disclosure.

Another example of a method 300 implemented by a fixture configuration module 32 and consistent with various embodiments described herein is illustrated in FIG. 13. The method 300 begins (block 305), according to this example, with the fixture configuration module 32 not yet coupled to the light fixture 10. The method 300 comprises programming the fixture configuration module 32 with a range received via near-field communication (NFC) signaling (block 310). The range identifies at least a subset of values of a lighting parameter supported by the light fixture 10 to produce light.

The fixture configuration module 32 is not coupled to the light fixture 10, and thus not receiving electrical power from the light fixture 10 via its connector 60. Nonetheless, the fixture configuration module 32 stores the range received via the NFC signaling in a non-volatile memory 240 of the fixture configuration module 32 while powered by magnetic induction produced by the NFC signaling (block 315).

In this example, the fixture configuration module 32 has a mechanical switch 90 (e.g., a rotary dial) corresponding to the lighting parameter, and may be positioned to one of a plurality of switch positions. One of said switch positions corresponds to the range programmed into the fixture configuration module 32 and received via the NFC signaling. Another of said switch positions corresponds to a different range that is preprogrammed in non-volatile memory 240 and is not received by the NFC circuitry. For example, this different range may be programmed during manufacturing using an EEPROM programming device (or other device). According to this example, the preprogrammed range and the range received via NFC signaling are stored in respective locations of the non-volatile memory 240, and the mechanical switch 90 designates which location in that non-volatile memory 240 (and correspondingly, which range) is to be used for limiting operation of the light fixture 10 (block 320). In particular, the fixture configuration module 32 designates one of these ranges from the plurality of different ranges responsive to a user 295 positioning the mechanical switch 90 to one of the switch positions.

In this example, the fixture configuration module 32 has a further mechanical switch 90 corresponding to a different lighting parameter. Accordingly, the fixture configuration module 32 designates a range of the different lighting parameter using this further mechanical switch 90 (block 325). In particular, the mechanical switch and the further mechanical switch 90 may designate a color temperature range of the light fixture 10 and a brightness range of the light fixture 10, respectively.

The fixture configuration module 32 is then removably coupled, via a connector 60 of the fixture configuration module 32, with a corresponding connector 70 of the light fixture 10, and receives electrical power from the light fixture 10 in response (block 330). Under the electrical power of the light fixture 10, the fixture configuration module 32 receives a software license (e.g., wirelessly from a remote device 290) and enables remote management of the light fixture 10 in response (block 335).

Having enabled remote management, the fixture configuration module 32 receives one or more values of the lighting parameter (e.g., through radio communication with the remote device 290) (block 340). The fixture configuration module 32 controls the light fixture 10 to produce light at such values of the lighting parameter that are received and are within the corresponding designated range (block 345).

The fixture configuration module 32 also has a mechanical reset button 250. If the reset button 250 is pressed (block 350, yes), the fixture configuration module 32 overrides the range of the lighting parameter received via NFC signaling and stored in the non-volatile memory 240 with a default range in response (block 355). Otherwise (block 350, no), the range received via NFC is not overridden.

If the fixture configuration module 32 is not decoupled from the light fixture 10 (block 360, no), the fixture configuration module 32 will continue to receive further lighting parameter values (block 340) and controlling the light fixture according to the designated ranges (block 345), until the fixture configuration module 32 is either reset (block 350, yes) and/or decoupled (block 360, yes). Once the fixture configuration module 32 is decoupled (block 360, yes), the method 300 ends.

Embodiments of the present disclosure may, of course, be carried out in other ways than those specifically set forth herein without departing from essential characteristics of the disclosure. In particular, other methods may include one or more combinations of the various functions and/or steps described herein. Although steps of various processes or methods described herein may be shown and described as being in a particular sequence or temporal order, the steps of any such processes or methods are not limited to being carried out in any particular sequence or order, absent an indication otherwise. Indeed, the steps in such processes or methods generally may be carried out in various different sequences and/or orders while still falling within the scope of the present disclosure. Moreover, embodiments of the fixture configuration module 32 may be arranged in a variety of different ways, including (in some embodiments) according to different combinations of the various hardware elements described above. Accordingly, the present embodiments described herein are to be considered in all respects as illustrative and not restrictive, and all changes coming within the meaning and equivalency range of the appended claims are intended to be embraced therein.

What is claimed is:

1. A light fixture, comprising:

a light source;

driver circuitry configured to control the light source in accordance with a range of a lighting parameter; and fixture configuration circuitry configured to:

store a plurality of different ranges of the lighting parameter, each of the different ranges identifying at least a subset of values of the lighting parameter supported by the light source;

communicate with a device via near-field communication (NFC) signaling; and set the range of the lighting parameter of the driver circuitry from one of the plurality of different ranges stored by the fixture configuration circuitry in accordance with the NFC signaling.

2. The light fixture of claim 1, wherein the fixture configuration circuitry is further configured to receive instructions from the device via NFC signaling.

3. The light fixture of claim 2, wherein in response to the instructions from the device, the fixture configuration circuitry is further configured to adjust at least one of the plurality of different ranges stored by the fixture configuration circuitry.

4. The light fixture of claim 2, wherein in response to the instructions from the device, the fixture configuration circuitry is further configured to select at least one of the plurality of different ranges stored by the fixture configuration circuitry to set the range of the lighting parameter of the driver circuitry.

5. The light fixture of claim 2, wherein the fixture configuration circuitry is further configured to store the instructions from the device in non-volatile memory.

6. The light fixture of claim 2, wherein in response to the instructions comprising a new range of the lighting parameter, the fixture configuration circuitry is further configured to store the new range as one of the plurality of different ranges of the lighting parameter.

7. The light fixture of claim 1, wherein the fixture configuration circuitry is further configured to receive the one of the plurality of different ranges wirelessly in accordance with the NFC signaling.

8. The light fixture of claim 1, further comprising non-volatile memory comprising:

a read only memory configured to store the plurality of different ranges; and a programmable memory configured to store the set range.

9. The light fixture of claim 8, further comprising user interface circuitry communicatively coupled to the fixture configuration circuitry, wherein the user interface circuitry is configured to add at least one further range to the plurality of different ranges stored in the non-volatile memory in accordance with received input.

10. The light fixture of claim 9, wherein the user interface circuitry comprises radio circuitry configured to receive the input via radio communication.

11. The light fixture of claim 1, wherein the fixture configuration circuitry is further configured to designate one of the plurality of different ranges by default.

12. The light fixture of claim 1, wherein the plurality of different ranges comprises at least one of a plurality of color temperature ranges or a plurality of brightness ranges.

13. The light fixture of claim 1, wherein:

the driver circuitry is configured to control the light source in accordance with a first range of a first lighting parameter and a second range of a second lighting parameter; and the fixture configuration circuitry is further configured to store a first plurality of different ranges of the first lighting parameter and store a second plurality of different ranges of the second lighting parameter.

14. The light fixture of claim 13, wherein the first plurality of different ranges comprises a plurality of color temperature ranges and the second plurality of different ranges comprises a plurality of brightness ranges.

15. The light fixture of claim 14, wherein the fixture configuration circuitry is further configured to set the second range of the second lighting parameter of the driver circuitry based on the NFC signaling.

16. The light fixture of claim 14, wherein when the NFC signaling does not indicate the second range, the fixture configuration circuitry is further configured to set the second range of the second lighting parameter of the driver circuitry to a default range.

17. The light fixture of claim 13, wherein the fixture configuration circuitry is further configured to set the first range of the first lighting parameter of the driver circuitry from one of the first plurality of different ranges stored by the fixture configuration circuitry in accordance with the NFC signaling.

18. The light fixture of claim 1, further comprising:

user interface circuitry communicatively coupled to the driver circuitry and configured to receive one or more values of the lighting parameter;

wherein the driver circuitry is configured to control the light fixture to produce the light at the one or more values of the lighting parameter received by the user interface circuitry that are within the range set by the fixture configuration circuitry.

19. The fixture configuration module of claim 18, wherein the user interface circuitry comprises radio circuitry configured to receive the one or more values of the lighting parameter via radio communication.

20. The fixture configuration module of claim 18, wherein the driver circuitry is configured to ignore values of the lighting parameter received by the user interface circuitry that are outside the range set by the fixture configuration circuitry.

* * * * *